US009541310B2

(12) United States Patent
Yokoyama et al.

(10) Patent No.: US 9,541,310 B2
(45) Date of Patent: Jan. 10, 2017

(54) SEALED COMPRESSOR AND VAPOR COMPRESSION REFRIGERATION CYCLE APPARATUS INCLUDING THE SEALED COMPRESSOR

(71) Applicants: Tetsuhide Yokoyama, Chiyoda-ku (JP); Shogo Moroe, Chiyoda-ku (JP); Yoshinori Shirafuji, Chiyoda-ku (JP); Teruhiko Nishiki, Chiyoda-ku (JP); Taro Kato, Chiyoda-ku (JP); Hideaki Maeyama, Chiyoda-ku (JP); Hiroki Nagasawa, Chiyoda-ku (JP); Keisuke Shingu, Chiyoda-ku (JP)

(72) Inventors: Tetsuhide Yokoyama, Chiyoda-ku (JP); Shogo Moroe, Chiyoda-ku (JP); Yoshinori Shirafuji, Chiyoda-ku (JP); Teruhiko Nishiki, Chiyoda-ku (JP); Taro Kato, Chiyoda-ku (JP); Hideaki Maeyama, Chiyoda-ku (JP); Hiroki Nagasawa, Chiyoda-ku (JP); Keisuke Shingu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 265 days.

(21) Appl. No.: 14/391,928

(22) PCT Filed: Jan. 16, 2013

(86) PCT No.: PCT/JP2013/050637
§ 371 (c)(1),
(2) Date: Oct. 10, 2014

(87) PCT Pub. No.: WO2013/157281
PCT Pub. Date: Oct. 24, 2013

(65) Prior Publication Data

US 2015/0052936 A1 Feb. 26, 2015

(30) Foreign Application Priority Data

Apr. 19, 2012 (JP) ..... 2012-095863

(51) Int. Cl.
*F25B 43/02* (2006.01)
*F25B 1/00* (2006.01)
(Continued)

(52) U.S. Cl.
CPC ..... *F25B 1/005* (2013.01); *F04B 39/0238* (2013.01); *F04B 39/0284* (2013.01); *F04B 39/04* (2013.01);
(Continued)

(58) Field of Classification Search
CPC ..... F25B 43/02; F25B 31/004; F25B 1/10; F04D 29/426
(Continued)

(56) References Cited

U.S. PATENT DOCUMENTS 4,531,894 A * 7/1985 Kawai ..... F04B 39/0027 181/255
6,231,317 B1 * 5/2001 Watanabe ..... F04C 29/028 417/410.5
(Continued)

FOREIGN PATENT DOCUMENTS

JP 52-24805 6/1977
JP 57-68583 4/1982
(Continued)

OTHER PUBLICATIONS

Combined Chinese Office Action and Search Report issued Dec. 15, 2015 in Patent Application No. 201380028116.X (with English language translation and English translation of categories of cited documents).
(Continued)

*Primary Examiner* — Melvin Jones
(74) *Attorney, Agent, or Firm* — Oblon, McClelland, Maier & Neustadt, L.L.P.

(57) ABSTRACT

A sealed compressor includes a centrifugal impeller above a rotor to synchronously rotate. A refrigerant rises through a rotor air hole, flows in an upper space, and flows out from a discharge pipe. The centrifugal impeller includes an oil separation plate on the rotor, and plural vanes standing on the oil separation plate, and forms inter-vane flow passages between adjacent vanes, and a vane inner flow passage that guides refrigerant from the rotor air hole to inner entrances of the inter-vane flow passages. Outer exits of the inter-vane flow passages are disposed along an entire circumference, and refrigerant increased in pressure while passing through the inter-vane flow passages flows out from the outer exits
(Continued)

to the upper space. The oil separation plate closes a short-circuit passage through which the refrigerant directly flows from the vane inner flow passages to the discharge pipe without passing through the inter-vane flow passages.

22 Claims, 11 Drawing Sheets

(51) Int. Cl.

| | |
|---|---|
| ***F04B 39/02*** | (2006.01) |
| ***F04B 39/04*** | (2006.01) |
| ***F25B 1/04*** | (2006.01) |
| ***F25B 31/00*** | (2006.01) |
| ***F04C 23/00*** | (2006.01) |
| ***F04C 29/02*** | (2006.01) |
| ***F04C 29/00*** | (2006.01) |
| ***F04D 25/06*** | (2006.01) |
| ***F04D 29/063*** | (2006.01) |
| ***F04D 29/66*** | (2006.01) |
| *F04C 29/04* | (2006.01) |
| *F04C 18/02* | (2006.01) |
| *F04C 18/356* | (2006.01) |

(52) U.S. Cl.
CPC ..... *F04C 18/0207* (2013.01); *F04C 23/008* (2013.01); *F04C 29/0021* (2013.01); *F04C 29/026* (2013.01); *F04D 25/06* (2013.01); *F04D 29/063* (2013.01); *F04D 29/662* (2013.01); *F25B 1/04* (2013.01); *F25B 31/004* (2013.01); *F25B 43/02* (2013.01); *F04C 18/02* (2013.01); *F04C 18/356* (2013.01); *F04C 29/045* (2013.01); *F04C 2240/807* (2013.01); *F04C 2240/809* (2013.01); *F04C 2270/20* (2013.01)

(58) Field of Classification Search
USPC ..... 62/470, 478; 417/423.14, 423.7
See application file for complete search history.

(56) References Cited

U.S. PATENT DOCUMENTS

2011/0271709 A1* 11/2011 Kinjo ..... F04B 39/02 62/498
2012/0288382 A1* 11/2012 Yamaoka ..... F04B 35/04 417/410.1

FOREIGN PATENT DOCUMENTS

| | | |
|---|---|---|
| JP | 5-61487 | 8/1993 |
| JP | 3925392 | 6/2007 |
| JP | 2009-264175 | 11/2009 |
| JP | 2010-265849 | 11/2010 |

OTHER PUBLICATIONS

International Search Report issued Apr. 23, 2013, in PCT/JP13/050637 filed Jan. 16, 2013.
"Turbo Air—Sending Device and Compressor", Corona Publishing Co., Ltd., 1988, 5 pages.
"Fluid Mechanical Engineering", Corona Publishing Co., Ltd., 1983, 1 page.

* cited by examiner

SEALED COMPRESSOR AND VAPOR COMPRESSION REFRIGERATION CYCLE APPARATUS INCLUDING THE SEALED COMPRESSOR

TECHNICAL FIELD

The present invention relates to a sealed compressor and a vapor compression refrigeration cycle apparatus including the sealed compressor and, more particularly, to a sealed compressor having high oil separating effect and a vapor compression refrigeration cycle apparatus including the sealed compressor.

BACKGROUND ART

As a refrigerant compressor used in a vapor compression refrigeration cycle apparatus (a heat pump apparatus or a refrigeration cycle apparatus), a refrigerant compressor has hitherto been used in which the rotating force of a motor is transmitted to a compression mechanism via a drive shaft so as to compress a refrigerant gas. In such a refrigerant compressor, the refrigerant gas compressed by the compression mechanism is discharged into a sealed container, moves through a motor gas flow passage from a lower space to an upper space with respect to the motor, and is then discharged to a refrigerant circuit outside the sealed container. At this time, lubricant oil supplied to the compression mechanism is discharged out of the sealed container while mixing with the refrigerant gas. Conventionally, when the amount of discharged oil to be carried to the refrigerant circuit increases, the performance of a heat exchanger deteriorates, or when the amount of oil stored in the sealed container decreases, compressor efficiency is reduced due to an increase in leakage of the compressed gas. Further, the reliability deteriorates due to lubrication failure of the compressor.

In recent years, size reduction of refrigerant compressors and conversion of the refrigerant used to an alternative refrigerant with little environment load (including natural refrigerants) have accelerated, and there has been a demand to sophisticate the technique of oil separation in the sealed container. On the other hand, the flow states of the refrigerant and lubricant oil during high-speed rotation of the motor in the sealed container and the mechanism of oil separation are considerably complicated, and it is not easy to make an experiment for observing the high-pressure interior of the sealed container. Hence, there are many unidentified details and many unsolved technical problems.

In a high-pressure shell scroll compressor described in Patent Literature 1, a refrigerant drawn by suction by a compression mechanism disposed in the inner upper part of a sealed container is compressed, is temporarily lowered to an oil reservoir at the bottom of the sealed container, and is then lifted from a lower space to an upper space with respect to a motor through a motor gas flow passage, and a high-pressure gas is discharged from a compressor discharge pipe. The high-pressure shell scroll compressor described in Patent Literature 1 includes a fan provided above a motor rotor, and partition plates attached to a motor stator and the motor rotor. The refrigerant and lubricant oil are separated by the centrifugal force generated upon rotation of the fan, and the pressure resistance of the flow in a gap between the partition plates. This prevents the lubricant oil remaining to be separated from the refrigerant from directly flowing into the discharge pipe, that is, prevents the lubricant oil from flowing out of the sealed container.

Patent Literature 2 discloses an oil separation device for a sealed electric compressor including an electrically driven element stored in the inner upper part of a sealed container, a compression element to be driven by the electrically driven element, an oil separation plate opposed to an upper end ring of a rotor of the electrically driven element with a predetermined space between them, and stirring vanes planted on the oil separation plate. In the sealed electric compressor, the stirring vanes are planted only on the lower surface of the oil separation plate.

The effect of the oil separation devices disclosed in Patent Literatures 1 and 2 (the fan and the partition plates in Patent Literature 1, and the oil separation plate and the stirring vanes in Patent Literature 2) for improving the oil separation state in the compressor sealed container is confirmed generally.

Further, it has recently become possible to visualize the flow states of the refrigerant and lubricant oil in the compressor sealed container by utilizing the three-dimensional fluid simulation technique that has made remarkable advance, and new findings have been obtained. For example, Patent Literature 3 discloses a refrigerant compressor in which, by utilizing an increase in head pressure occurring near a leading end portion, in the rotational direction, of an upper balance weight fixed to the upper end of a rotor in a motor provided in a sealed container, an oil return flow passage is formed from the portion near the leading end portion toward the lower end, and high-concentration lubricant oil exposed around the rotor is returned to the lower side of the motor to prevent oil loss.

Usually, a rotor of a DC brushless motor used in the existing compressor has a structure shaped like a circular cylinder in which circular steel sheets are stacked and the upper and lower surfaces of the stack are clamped between metal flat plates. An upper balance weight is accessorily provided on the upper side of an upper end of the rotor, and a lower balance weight is accessorily provided on the lower end of the rotor.

CITATION LIST

Patent Literature

Patent Literature 1: Japanese Patent No. 3925392

Patent Literature 2: Japanese Unexamined Utility Model Registration Application Publication No. 5-61487

Patent Literature 3: Japanese Unexamined Patent Application Publication No. 2009-264175

Non-Patent Literature

Non-Patent Literature 1: *Ta-bo Soufuuki to Asshukuki* (*Turbo Air—Sending Device and Compressor*), Corona Publishing Co., Ltd. (Showa 63)

Non-Patent Literature 2: *Ryuutai Kikai Kougaku* (*Fluid Mechanical Engineering*), Corona Publishing Co., Ltd. (Showa 58)

SUMMARY OF INVENTION

Technical Problem

In general, to configure a high-performance centrifugal air-sending device, as described in Non-Patent Literature 1, for example, the shape of an impeller itself, the shape of a flow passage upstream of the impeller, and the shape of a flow passage downstream of the impeller are designed on the basis of theoretical calculation.

However, Patent Literatures 1 and 2 do not disclose theoretical design methods for the fan and the vanes attached to the upper side of the rotor of the motor disclosed therein, and the best fan and vanes to improve the oil separation state are not configured. In the conventional sealed compressor, there is room to further improve oil separation performance by more appropriately using the centrifugal fan.

For example, in the high-pressure shell scroll compressor described in Patent Literature 1, since the fan provided on the upper side of the motor rotor is disposed only on one side where the upper balance weight is not provided, the pressure distribution and the flow rate distribution within the motor upper space greatly vary upon nonuniform rotation of the fan. If this structure is simply applied to a rotary compressor as it is, it hinders oil droplets suspended in the motor upper space from settling out by gravity, or disturbs the surface of oil accumulated on the upper side of the stator. This may whirl up the oil droplets and may increase the outflow amount to the outside of the sealed container.

In the rotary compressor described in Patent Literature 2, the oil separation plate provided on the upper side of the motor rotor has a large circular hole near the center on the inner peripheral side of the stirring vanes, and a discharge pipe through which the refrigerant is guided to the outside of the sealed container is inserted in the circular hole. Since a sufficient gap for the refrigerant gas to flow is provided between the circular hole and the discharge pipe, the refrigerant gas rising through a rotor air hole penetrating the rotor in the up-down direction directly flows into the discharge pipe without passing through inter-vane flow passages provided between the stirring vanes.

The present invention has been made to solve the above problems. The first object of the invention is to obtain a sealed compressor that separates lubricant oil by utilizing rotation of vanes attached to the upper portion of a motor rotor within a container, that prevents a decrease in amount of lubricant oil stored at the inner bottom of the container, and that can suppress deterioration of reliability and deterioration of energy saving performance due to lubrication failure. The second object of the invention is to obtain a vapor compression refrigeration cycle apparatus including the sealed compressor.

Solution to Problem

A sealed compressor according to the present invention includes a sealed container that stores lubricant oil at a bottom thereof, a motor that is provided within the sealed container and has a stator and a rotor, a drive shaft attached to the rotor, a compression mechanism that is provided within the sealed container and configured to compress a refrigerant upon rotation of the drive shaft, a centrifugal impeller that is provided above the rotor and configured to rotate in synchronization with the rotor, and a discharge pipe that communicates with an upper space of the motor and is configured to cause the refrigerant to flow out from the upper space to an external circuit of the sealed container. The rotor has a rotor air hole penetrating in an up-down direction. The refrigerant flowing in a lower space of the motor rises through the rotor air hole, flows into the upper space of the motor, and flows out from the discharge pipe.

The centrifugal impeller includes an oil separation plate provided at a predetermined distance to the upper side from an upper end of the rotor, a plurality of vanes that stand downwards from a lower surface of the oil separation plate and are provided from an inner peripheral side toward an outer peripheral side, inter-vane flow passages each provided between two adjacent vanes of the plurality of vanes, and a vane inner flow passage that guides the refrigerant flowing out from an upper end opening defining the rotor air hole to inner peripheral entrances of the inter-vane flow passages. The inter-vane flow passages are arranged along an entire circumference to guide the refrigerant from the inner peripheral entrances thereof to outer peripheral exits thereof, and cause the refrigerant increased in pressure while passing through the inter-vane flow passages to flow out from the outer peripheral exits into the upper space.

The oil separation plate closes an upper surface of the inter-vane flow passages and an upper end of the vane inner flow passage to close a short-circuit passage through which the refrigerant directly flows out to the discharge pipe without passing through the inter-vane flow passages.

A vapor compression refrigeration cycle apparatus according to the present invention includes a sealed compressor according to the present invention, a radiator that rejects heat from the refrigerant compressed by the sealed compressor, an expansion mechanism that expands the refrigerant, upon flowing out of the radiator, and an evaporator that causes the refrigerant, upon flowing out of the expansion mechanism, to receive heat.

Advantageous Effects of Invention

According to the present invention, it is possible to prevent a decrease in amount of lubricant oil stored in the container and to obtain the effect of suppressing deterioration of reliability due to lubrication failure and the effect of enhancing the energy saving performance.

DESCRIPTION OF EMBODIMENTS

Embodiment 1

Figure 1:
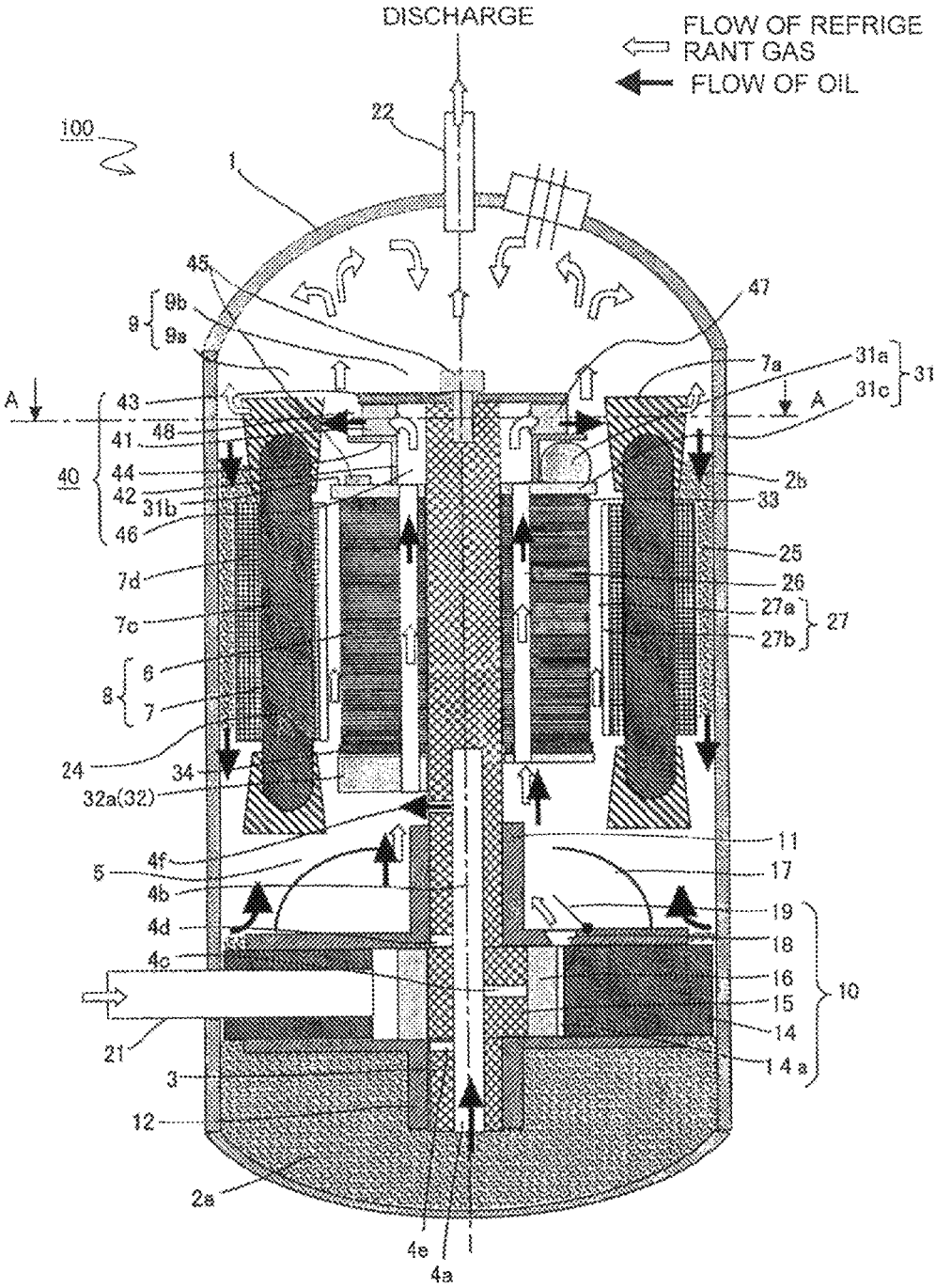
FIG. 1 is a longitudinal sectional view illustrating the structure of a sealed compressor according to Embodiment 1 of the present invention.
Figure 2:
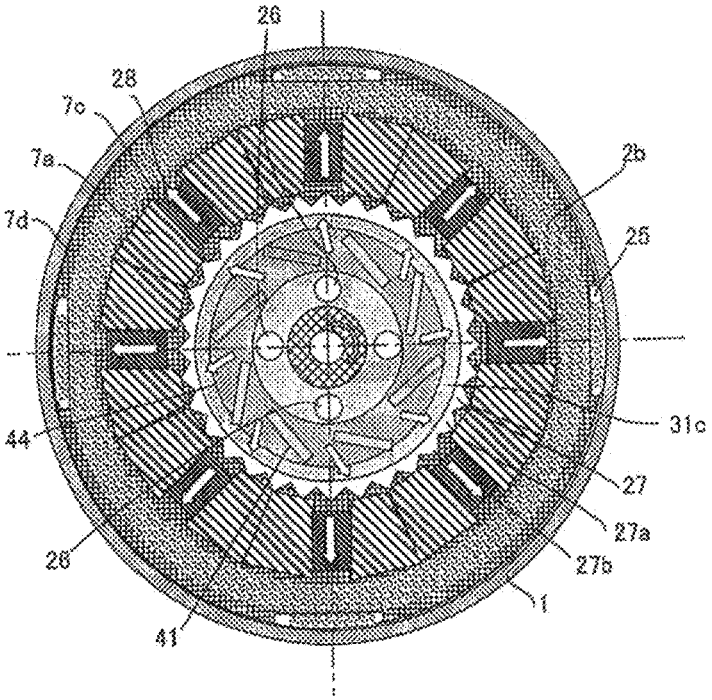
FIG. 2 is a transverse sectional view of the sealed compressor according to Embodiment 1 of the present invention (a sectional view taken along a line A-A of FIG. 1).

FIG. 1 is a longitudinal sectional view illustrating the structure of a sealed compressor according to Embodiment 1 of the present invention. FIG. 2 is a transverse sectional view of the sealed compressor according to Embodiment 1 of the present invention (a sectional view taken along a line A-A of FIG. 1). First, the basic structure and operation of a sealed compressor 100 according to Embodiment 1 will be described with reference to FIGS. 1 and 2.

[Basic Structure and Operation of Sealed Compressor 100]

The sealed compressor 100 according to Embodiment 1 is implemented using a high-pressure shell, sealed rotary compressor, and, as illustrated in FIG. 1, includes a sealed container 1 in which a sealed-container bottom oil reservoir 2*a* for storing lubricant oil is provided in its bottom part, and a motor 8, a drive shaft 3, and a compression mechanism 10 that are housed within the sealed container 1.

The motor 8 includes a substantially cylindrical stator 7 having, in its inner peripheral portion, a through hole penetrating in the up-down direction, and a substantially cylindrical rotor 6 disposed on the inner peripheral side of the stator 7 with a predetermined air gap 27*a* between them. For example, the motor 8 in Embodiment 1 is implemented using a DC brushless motor. The stator 7 is formed by stacking steel sheets. A coil is densely wound around a core 7*d* to form a coil winding block 7*c*. The stator 7 is attached to the inner peripheral surface of the sealed container 1 by, for example, press fitting or welding. The rotor 6 is formed by stacking steel sheets and clamping the upper and lower ends of the stack of steel sheets between a rotor upper fixing substrate 33 and a rotor lower fixing substrate 34. A magnet is disposed in the rotor 6. An upper balance weight 31 and a lower balance weight 32 having projections in opposite phases are disposed on the upper surface of the rotor upper fixing substrate 33 and the lower surface of the rotor lower fixing substrate 34, respectively. The rotor 6 of Embodiment 1 has four rotor air holes 26 penetrating in the up-down direction. It is only necessary that the number of rotor air holes 26 should be at least one.

The drive shaft 3 is attached at its upper end portion to the rotor 6 of the motor 8 and at its lower end portion to the compression mechanism 10. That is, the drive shaft 3 transmits a driving force of the motor 8 to the compression mechanism 10. The drive shaft 3 is rotatably held by an upper bearing section 11 and a lower bearing section 12 disposed below the motor 8.

The compression mechanism 10 compresses a refrigerant by a driving force of the motor 8 transmitted via the drive shaft 3. While the present invention does not limit the structure of the compression mechanism, Embodiment 1 adopts a rotary compression mechanism. The compression mechanism 10 includes a cylinder 14, a rotary piston 16, and so on. The cylinder 14 has a through hole penetrating in the up-down direction, and upper and lower openings defining the through hole are closed by the upper and lower bearing sections 11 and 12, respectively. The through hole of the cylinder 14 serves as a cylinder chamber 14*a*. The rotary piston 16 is disposed in the cylinder chamber 14*a*. The rotary piston 16 is substantially cylindrical, and is attached to the outer periphery of an eccentric pin shaft portion 15 eccentrically provided on the drive shaft 3. That is, in the compression mechanism 10 of Embodiment 1, the eccentric pin shaft portion 15 revolves with rotation of the drive shaft 3, and the rotary piston 16 revolves together with the eccentric pin shaft portion 15 within the cylinder chamber 14*a*, so that a refrigerant gas drawn by suction from a suction pipe 21 is compressed within the cylinder chamber 14*a*. When the pressure of the compressed refrigerant gas reaches a predetermined pressure, the compressed gas pushes up a discharge valve 19 that opens and closes a discharge port 18 provided in the upper surface of the upper bearing section 11, passes through the discharge port 18, and is discharged from the cylinder chamber 14*a* into the internal space of a discharge muffler 17.

[Discharged Gas Outflow Passage]

The refrigerant gas compressed and discharged in the internal space of the discharge muffler 17 further passes through a motor lower space 5 and a flow passage penetrating the motor in the up-down direction, and flows into a motor upper space 9 (stator upper space 9*a* and rotor upper space 9*b*). The refrigerant that has flowed in the motor upper space 9 is discharged from a discharge pipe 22 provided at the top of the sealed container, that is, the discharge pipe 22 communicating with the motor upper space 9 to the outside of the sealed container 1, and is delivered to a radiator-side refrigerant circuit.

The following four types of flow passages are main gas flow passages penetrating the motor in the up-down direction:

(1) rotor air holes 26 which are flow passages penetrating the rotor 6 in the up-down direction (that is, the axial direction of the drive shaft 3), (2) a stator inner peripheral flow passage 27 which is formed by the air gap 27*a* provided between the outer periphery of the rotor 6 and the inner periphery of the stator 7, and a core inner peripheral cutout flow passage 27*b* of the stator 7, (3) a stator outer peripheral flow passage 25 which is formed in a gap between the cylinder-side inner periphery of the sealed container 1 and the stator 7 by cutting the outer periphery of the core 7*d* of the stator 7, and (4) a coil gap flow passage 24 which is an inter-gap flow passage penetrating in the up-down direction in the coil winding block 7*c* in which the coil is densely wound around the core 7*d* of the stator.

Assuming that the motor 8 of Embodiment 1 is implemented using a DC brushless motor having a stator 7 of a distributed winding coil, the flow passage area of the coil gap flow passage 24 of (4) (the area when the flow passage is cut perpendicularly to the flow direction) is sufficiently small, and therefore, may be ignored. Even when large holes are formed as the rotor air holes 26 of (1), the efficiency is not influenced unless they interfere with the magnet, and therefore, the rotor air holes 26 can have a sufficiently large flow passage area. In contrast, as the flow passage areas of the stator inner peripheral flow passage 27 of (2) and the stator outer peripheral flow passage 25 of (3) increase, the efficiency of the motor 8 decreases. Hence, the flow passage areas of the stator inner peripheral flow passage 27 and the stator outer peripheral flow passage 25 are limited.

[Oil Flow and Oil Outflow Passage]

Lubricant oil stored in the sealed-container bottom oil reservoir 2*a* is supplied to the components of the compression mechanism 10. Specifically, when the drive shaft 3 rotates, the lubricant oil stored in the sealed-container bottom oil reservoir 2*a* is drawn up by suction from an oil suction hole 4*a* at the lower end of the drive shaft 3, and is caused to flow into a cavity 4*b* penetrating the shaft center of the drive shaft 3. The lubricant oil is then supplied from oil supply holes 4*c*, 4*d*, and 4*e* into the gap between the outer periphery of the eccentric pin shaft portion 15 and the inner periphery of the rotary piston 16, the gap between the outer periphery of the drive shaft 3 and the inner periphery of the upper bearing section 11, and the gap between the outer periphery of the drive shaft 3 and the inner periphery of the lower bearing section 12, respectively. This contributes to lubrication of the compression mechanism 10 and sealing of the compressed gas. A component, which does not flow in the oil supply holes 4*c*, 4*d*, and 4*e*, of the lubricant oil that has flowed in the cavity 4*b*, flows out into the motor lower space 5 from a degassing hole 4*f* communicating with a portion of the cavity 4*b* near its upper end (above the upper bearing section 11).

The high-pressure lubricant oil in the sealed-container bottom oil reservoir 2*a* flows through the oil supply hole 4*c* of the drive shaft 3 and other gaps, passes through the gaps on the upper and lower sides of the rotary piston 16, and is supplied to the cylinder chamber 14*a* by differential pressure. A component of the lubricant oil is compressed, and is discharged from the discharge port 18 into the motor lower space 5 while mixing with the refrigerant gas. A component, which does not flow in the oil supply holes 4*c*, 4*d*, and 4*e*, of the lubricant oil that has flowed in the cavity 4*b*, flows out into the motor lower space 5 from the degassing hole 4*f* communicating with the portion of the cavity 4*b* near the upper end (above the upper bearing section 11). When the rotor 6 rotates, the oil surface in the sealed-container bottom oil reservoir 2*a* is stirred and ruffled, and the lubricant oil is whirled up by the refrigerant gas discharged from the cylinder chamber 14*a*. As described above, particles (oil droplets), which are not separated, of particles mixed in the refrigerant gas within the motor lower space 5, pass together with the refrigerant gas from the motor lower space 5 through the gas flow passages (1), (2), (3), and (4) penetrating the motor in the up-down direction, and rise to the motor upper space 9. Further, oil droplets, which are not separated in the motor upper space 9, flow out of the sealed container 1 from the discharge pipe 22 together with the refrigerant gas. The oil outflow rate is defined as [oil outflow volume/(oil outflow volume+refrigerant circulation volume)]. As the oil outflow rate decreases, the oil separation state improves.

<Stator Upper Oil Reservoir 2*b* and Problems>

The oil droplets separated in the motor upper space 9 are likely to be collected on the side wall side of the sealed container 1 in the stator upper space 9*a* by a centrifugal force acting upon the rotation of the rotor 6, and are likely to settle out just on the upper side of the outer periphery of the stator 7. These oil droplets pass through the stator outer peripheral flow passage 25, and return while falling from the motor upper space 9 into the motor lower space 5.

At this time, when the flow passage area of the stator outer peripheral flow passage 25 is relatively larger than the oil droplets falling on the upper side of the upper outer periphery of the stator 7, the lubricant oil falls through the stator outer peripheral flow passage 25 where the ascending refrigerant gas and the oil droplets descending by gravity coexist.

As the flow rate of the gas refrigerant increases and the number of oil droplets falling on the upper side of the upper outer periphery of the stator 7 increases, the lubricant oil runs down in the stator outer peripheral flow passage 25 that is clogged with the oil droplets.

When the flow rate of the gas refrigerant further increases, the decrease in pressure in the motor upper space 9 due to pressure loss increases, and the lubricant oil further accumulates on the upper side of the outer periphery of the stator 7. That is, a stator upper oil reservoir 2*b* illustrated in FIG. 1 is formed. For this reason, the amount of oil stored in the sealed-container bottom oil reservoir 2*a* is reduced by the amount of oil accumulated on the upper side of the outer periphery of the stator 7, and the height of the oil surface in the sealed-container bottom oil reservoir 2*a* decreases accordingly. Alternatively, the amount of oil, which is whirled up from the stator upper oil reservoir 2*b* and flows from the discharge pipe 22 to the outside of the sealed container together with the refrigerant gas, increases. As a result, the amount of oil supplied to the compression mechanism 10 decreases, and this causes deterioration of lubrication reliability and an increase in amount of leakage of the compressed gas.

To overcome this, in Embodiment 1 of the present invention, the following centrifugal impeller 40 is provided above the rotor 6 to prevent an increase in amount of oil flowing out of the sealed container 1, that is, a decrease in amount of oil stored in the sealed-container bottom oil reservoir 2*a*. Specifically, the pressure in the motor upper space 9 is increased by the centrifugal impeller 40 such that the pressure in the motor upper space 9 becomes higher than that in the motor lower space 5. Alternatively, the decrease in pressure in the motor upper space 9 is suppressed more than in the conventional technique to prevent an increase in amount of oil flowing out of the sealed container 1 (that is, a decrease in amount of oil stored in the sealed-container bottom oil reservoir 2*a*).

Components that constitute the centrifugal impeller 40 according to Embodiment 1 will be described together with advantageous effects produced by the components.

[Structure and Feature of Centrifugal Impeller 40]

As illustrated in FIG. 1, the upper end and the lower end of the rotor 6 formed by stacked steel sheets are clamped by the rotor upper fixing substrate 33 and the rotor lower fixing substrate 34, and a projection 31*a* of the upper balance weight 31 and a projection 32*a* of the lower balance weight 32, which are disposed in opposite phases, are provided with predetermined thicknesses along the outer peripheral edge of the rotor. Further, the centrifugal impeller 40 is attached to the distal end of the drive shaft 3 above the upper balance weight 31 by fixing bolts 45. As will be described later, the centrifugal impeller 40 according to Embodiment 1 includes a vane upper disk 43, and a plurality of (eight in Embodiment 1) vanes 41 standing downwards from the lower surface of the vane upper disk 43. The refrigerant gas, which has flowed to the upper side of the rotor 6 from the rotor air holes 26 provided in the rotor 6, passes through a vane inner flow passage 46, and flows into the centrifugal impeller 40. For this reason, in Embodiment 1, the rotor air holes 26 are disposed on the inner peripheral side of the projection 31*a* of the upper balance weight 31 such that the refrigerant gas flowing out to the upper side of the rotor 6 from the rotor air holes 26 easily flows into the centrifugal impeller 40.

(A) Cost Reduction Effect of Centrifugal Impeller 40

Figure 3:
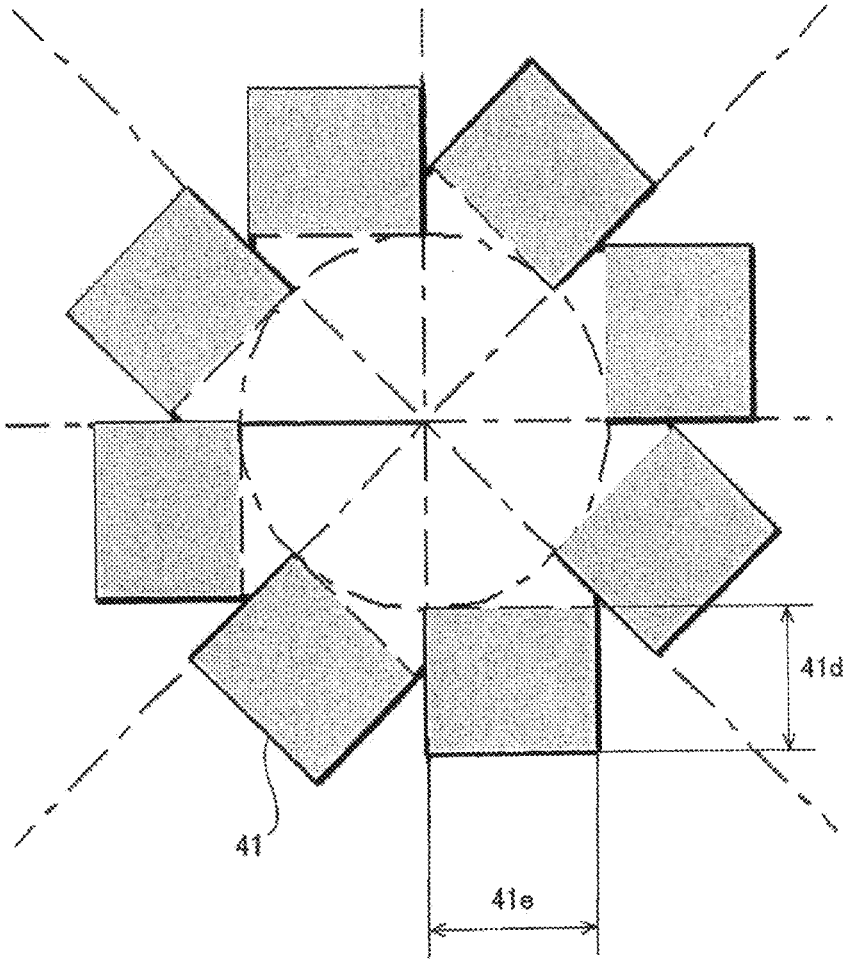
FIG. 3 is a developed view of (eight) vanes of a centrifugal impeller according to Embodiment 1 of the present invention.
Figure 4:
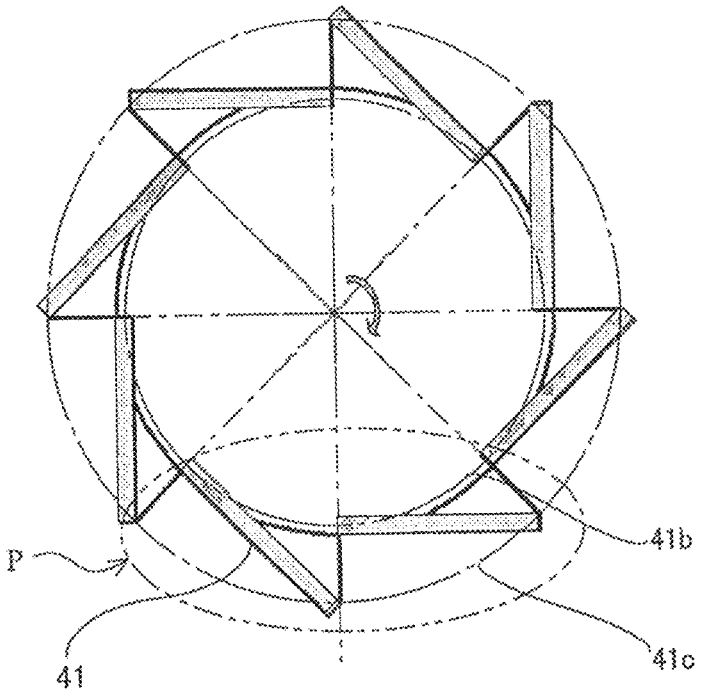
FIG. 4 is a top projection view illustrating the structure of the cut and raised (eight) vanes of Embodiment 1 of the present invention.
Figure 5:
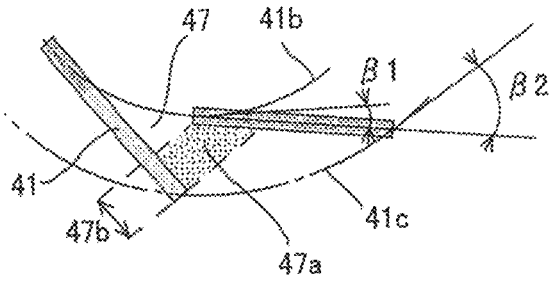
FIG. 5 is an enlarged view of a section P in FIG. 4.

FIG. 3 is a developed view of vanes (eight vanes) in the centrifugal impeller according to Embodiment 1 of the present invention. FIG. 4 is a top projection view illustrating the structure of the cut and raised vanes (eight vanes) in Embodiment 1 of the present invention. FIG. 5 is an enlarged view of a section P in FIG. 4.

In Embodiment 1, to reduce the cost of the centrifugal impeller 40, eight axially symmetrical vanes, as illustrated in FIG. 4, are produced by cutting and raising eight linear vanes at right angles from a single metal thin plate, as illustrated in a developed view of FIG. 3.

As illustrated in FIG. 5, a circle obtained by connecting the inner peripheral end portions of the vanes 41 having as their center the drive shaft 3 is defined as a short diameter circumference 41*b* and a circle obtained by connecting outer peripheral end portions of the vanes 41 having as their center the drive shaft 3 is defined as a long diameter circumference 41*c*. Then, the vanes 41 are linear vanes extending straight from the short diameter circumference 41*b* to the long diameter circumference 41*c*. An entrance angle $\beta_1$ formed by each of the vanes 41 and a tangent to the short diameter circumference 41*b* is about 0 degrees. Note that as illustrated in FIG. 5, an angle $\beta_2$ formed by each of the vanes 41 and a tangent to the long diameter circumference 41*c* is defined as an exit angle 132. An area where two vanes 41 overlap with each other in an inter-vane flow passage 47 formed between the vanes 41 serves as an effective flow passage area 47*a*, and an effective length of the vanes 41 in the effective flow passage area 47*a* is defined as an effective length 47*b*. The effective length 47*b* ensured in Embodiment 1 is ¼ or more of the total length 41*e* of the vanes 41.

(B) Leakage Reduction Effect of Centrifugal Impeller 40

However, if only the eight axially symmetrical vanes illustrated in FIGS. 3 to 5 are attached to the upper end of the drive shaft 3, a stream is produced to flow in and out through the intervening portion of each of the inter-vane flow passages 47 because the inter-vane flow passage 47 is open, that is, free from blocking on the entire lower side and on a part of the upper side. Particularly when the upper and lower surfaces of the effective flow passage area 47*a* in the inter-vane flow passage 47 are not closed, the fan efficiency decreases pronouncedly. Accordingly, Embodiment 1 takes the following countermeasures.

A vane upper disk 43 is attached to close the upper surface of the inter-vane flow passages 47 without any gap. In particular, the upper surface of the effective flow passage areas 47*a* in the inter-vane flow passages 47 is closed.

A vane lower disk 44 is attached to close the lower surface of the inter-vane flow passages 47 without any gap. In particular, the lower surface of the effective flow passage areas 47*a* in the inter-vane flow passages 47 is closed. The vane lower disk 44 has a flow passage hole provided on the inner peripheral side of the short diameter circumference 41*b* such that the refrigerant gas flowing out from the rotor air holes 26 to the upper side of the rotor 6 flows into the inter-vane flow passages 47.

The vane upper disk 43 corresponds to an oil separation plate in the present invention, and the vane lower disk 44 corresponds to a lower surface partition plate in the present invention. The oil separation plate and the lower surface partition plate do not always need to be disc-shaped, and it is only necessary that they can close the above-described areas. Each of the oil separation plate and the lower surface partition plate may be formed by a combination of a plurality of plates, instead of a single plate. In Embodiment 1, the oil separation plate and the lower surface partition plate are each shaped like a disk axially symmetrical with respect to the drive shaft 3 to prevent eccentric load from being applied to the drive shaft 3 upon rotation of the oil separation plate and the lower surface partition plate.

By preventing the refrigerant gas, which has flowed out of the centrifugal impeller 40 from the exits of the inter-vane flow passages 47, from being drawn by suction (short-circuited) again into the entrances of the inter-vane flow passages 47, the differential pressure between the entrance sides and the exit sides of the inter-vane flow passages 47 increases, and this can enhance the pressure increase effect of the centrifugal impeller 40. Accordingly, in Embodiment 1, the following flow guide is provided to separate the vane inner flow passage 46 for guiding the refrigerant from the upper ends of the rotor air holes 26 to the entrances of the inter-vane flow passages 47 from the exits of the inter-vane flow passages 47.

A hollow cylindrical (for example, hollow circular cylindrical) inner peripheral flow guide 42 having the vane inner flow passage 46 therein is provided such that its lower end portion is in contact with the upper end of the rotor 6 on the outer peripheral side of the rotor air holes 26 and such that its upper end portion is connected to the flow passage hole of the vane lower disk 44. In Embodiment 1, the upper balance weight 31 has a support flat plate 31*c* for fixing the projection 31*a* to the rotor 6. The support flat plate 31*c* has upper end openings defining the rotor air holes 26. In such a case, the lower end of the inner peripheral flow guide 42 may be in contact with the upper end of the support flat plate 31*c* (that is, the member having the upper end openings defining the rotor air holes 26).

The inner peripheral surface of the short diameter circumference 41*b* is also closed by the vane upper disk 43 to prevent the refrigerant gas, which has flowed out from the rotor air holes 26 to the upper side of the rotor 6, from flowing out into the motor upper space 9 without flowing in the inter-vane flow passages 47 (for example, this occurs when a hole or the like is formed at almost the center of the vane upper disk 43).

(C) Flow Loss Reduction Effect of Centrifugal Impeller 40

In Embodiment 1, the following structures are adopted to reduce pressure loss occurring in the centrifugal impeller 40.

The rotor air holes 26 are disposed on the inner peripheral side of the short diameter circumference 41*b* for easy guide to the entrances of the vane inner flow passages 46 through the vane inner flow passage 46.

The entrance angle $\beta_1$ of the vanes 41 that constitute the centrifugal impeller 40 is set to fall within the range of ±5 degrees. According to Non-Patent Literature 1 (p. 216), when the incident angle ib that is the difference between the relative inflow angle at the impeller entrance and the entrance angle of the vanes is 5 degrees or more, collision loss occurs, and this causes compressor loss. In high-speed rotation as in the air-conditioning condition, the rotation speed at the inner peripheral end portions of the vanes 41 is higher than the refrigerant flow speed. Hence, it is preferable to dispose the vanes 41 nearly in contact with the inner peripheral opening of the centrifugal impeller 40 (the flow passage hole of the vane lower disk 44).

(D) Method for Transmitting Static Pressure to Upper Side of Stator Outer Peripheral Flow Passage 25

At the upper end of the stator 7, a plurality of motor upper coil crossover wire portions 7*a* are provided as coil portions projecting from the coil winding block 7*c* to the upper side of the stator 7. In Embodiment 1, the shape of the motor upper coil crossover wire portions 7*a* projecting from the upper end of the stator 7 and the heights of the projection 31*a* of the upper balance weight 31 and the centrifugal impeller 40 are adjusted appropriately. The height of the projection 31*a* of the upper balance weight 31 is substantially equal to that of the coil winding block 7*c*, and the motor upper coil crossover wire portions 7*a* are disposed at almost the same height as that of the upper ends of the vanes 41 in the centrifugal impeller 40. The projection 31*a* of the rotating upper balance weight 31 causes a great increase in pressure (total pressure) from the head distal end in the forward rotational direction. This increase in pressure (total pressure) spreads over the entire motor upper space 9. In particular, great pressure variations and pressure distribution are generated in the same horizontal cross section (see Patent Literature 3). The pressure and flow speed greatly change in every rotation period of the rotor 6. This disturbs the oil droplets suspended in the stator upper space 9*a* on the upper side of the stator outer peripheral flow passage 25 and the oil surface in the stator upper oil reservoir 2*b*. Accordingly, in Embodiment 1, the oil droplets are prevented from being whirled up by covering the portion having as its upper limit the projection 31*a* of the upper balance weight 31 with the coil winding block 7*c*. Although the influence is less than that of the projection 31*a* of the upper balance weight 31, since the centrifugal impeller 40 may also become a small factor which disturbs the stator upper oil reservoir 2*b*, its periphery is covered with the motor upper coil crossover wire portions 7*a*. In contrast, radial flow passages 28 are provided between the adjacent motor upper coil crossover wire portions 7*a* such that the total pressure increased by the centrifugal impeller 40 is easily transmitted to the upper side of the stator outer periphery. On the upper side of the stator outer peripheral flow passage 25, the stator upper oil reservoir 2*b* is ensured in a space provided between the side wall of the sealed container 1 and the coil winding block 7*c*.

<Verification of Pressure Increase Effect>

Figure 6:
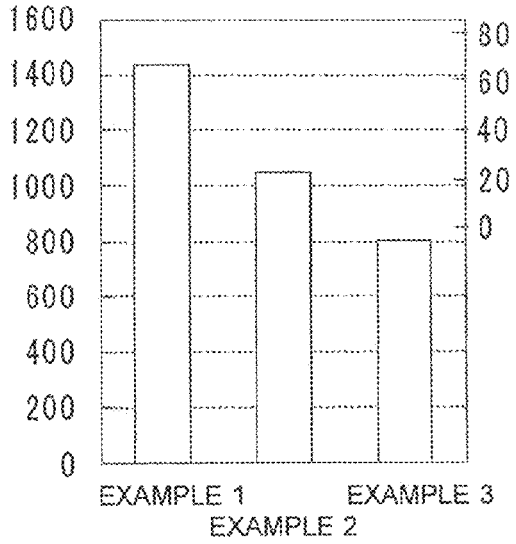
FIG. 6 is a bar chart showing a comparison of the oil-loss reducing effect of the centrifugal impeller according to Embodiment 1 of the present invention.

FIG. 6 is a bar chart showing a comparison of the oil-loss reducing effect of the centrifugal impeller according to Embodiment 1 of the present invention. The left vertical axis indicates the difference between a lower pressure $P_1$ of the stator outer peripheral flow passage 25 (the pressure in the motor lower space 5) and an upper pressure $P_2$ of the stator outer peripheral flow passage 25 (the pressure in the motor upper space 9). The right vertical axis indicates a height ΔH of the oil surface of lubricant oil accumulated on the upper side of the upper end of the stator outer peripheral flow passage 25 (this is the height of the oil surface in the stator upper oil reservoir 2*b*, and is expressed as a stator outer periphery upper oil surface height in FIG. 7).

Assuming that the flow speed of oil moving from the motor lower space 5 to the motor upper space 9 is comparatively low and letting $H_0$ ($H_0$=80 mm) be the length of the stator outer peripheral flow passage 25, the stator upper oil surface height ΔH is calculated according to the following Expression (1) from the balance relationship of the static force (the balance between pressure and gravity).

[Math. 1]

$$\Delta H = \frac{P_1 - P_2}{\rho g} - H_0 \quad (1)$$

where ρ represents the density of the lubricant oil, and g represents the gravity acceleration.

Figure 7:
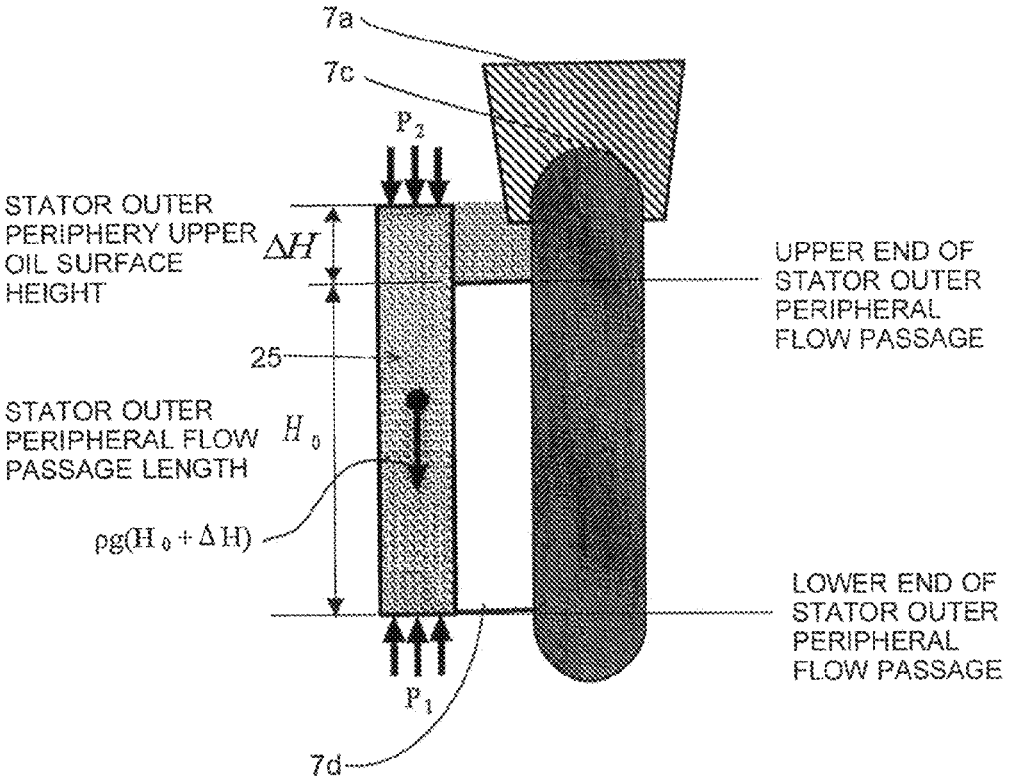
FIG. 7 is a characteristic diagram (longitudinal sectional view) showing the balance relationship of static force in a sealed container of the sealed compressor of Embodiment 1.

FIG. 7 is a longitudinal sectional view showing the balance relationship of static force in the sealed container of the sealed compressor according to Embodiment 1. The calculation conditions are assumed such that the refrigerant type is R22, the discharge pressure in the ASHRAE condition is 2.15 Mpa, the flow rate of the refrigerant gas is 160 kg/h, and the rotation speed of the motor 8 is 50 rps. The height of the vanes 41 in the centrifugal impeller 40 is 10 mm, the diameter of the circumference obtained by connecting the entrance end portions of the vanes 41 is 44 mm, and the diameter of the circumference obtained by connecting the exit end portions of the vanes 41 is 64 mm. It is assumed that the motor is in a state in which the rotor adopts a magnet-incorporated DC brushless motor type and has two rotor air holes, the stator is implemented using a distributed winding coil, and the stator outer peripheral flow passage 25 is clogged with oil. The static pressure distribution in the sealed container was calculated using a three-dimensional general-purpose thermo-fluid analysis tool (see Patent Literature 3), the pressures $P_1$ and $P_2$ in the vicinities of the upper part and the lower end of the stator outer peripheral flow passage 25 were found, and the stator outer periphery upper oil surface height was calculated by substituting the stator outer periphery upper and lower differential pressure ($P_1$−$P_2$) into Expression (1).

As can be seen from FIG. 6, in Example 1), that is, when the centrifugal impeller 40 is not provided, it is estimated that the upper and lower differential pressure ($P_1$−$P_2$) is 1420 Pa and that the stator outer periphery upper oil surface height (ΔH) is 50 mm.

In Example 2), that is, when the centrifugal impeller 40 is formed by the vane upper disk 43 and the eight vanes 41, it is estimated that the upper and lower differential pressure ($P_1$−$P_2$) is 1020 Pa and that the stator upper oil surface height (ΔH) is 22 mm. The upper and lower differential pressure ($P_1$−$P_2$) is reduced by 400 Pa by the pressure increase effect of the centrifugal fan.

Further, in Example 3), that is, when the centrifugal impeller 40 is formed by the vane upper disk 43, the eight vanes 41, and the vane lower disk 44, it is estimated that the stator upper oil surface height (ΔH) is −3 mm, and the upper and lower differential pressure ($P_1$−$P_2$) is reduced to 800 Pa by the pressure increase effect. That is, no lubricant oil accumulates on the stator outer peripheral portion at all.

The amount of work of the rotor 6 and the rotating bodies (drive shaft 3 and centrifugal impeller 40) was calculated as 9 W in Example 1), 11 Win Example 2), and 13 W in Example 3). In Example 3), the amount of work of the centrifugal impeller was 6 W. These amounts of work are 1% or less of an input power of 2.5 kW of the motor 8.

Non-Patent Literature 2 (p. 132) describes the total efficiencies of various fans. Comparing a turbo fan (exit angle <90 degrees), a radial fan (exit angle=90 degrees), and a multivane fan (exit angle >90 degrees) as a centrifugal air-sending device (centrifugal impeller), in general, the turbo fan has a highest efficiency. Usually, the efficiency is highest when the entrance angle $\beta_1$ of the vanes is about 0 degrees. It is known that the relative pressure increase amount with respect to the vane size increases as the exit angle $\beta_2$ increases.

Accordingly, in Embodiment 1, since the pressure increase effect to be obtained for an improvement of oil separation is about 1 kPa, the centrifugal impeller 40 is designed as a turbo fan having an entrance angle $\beta_1$ of about 0 degrees in terms of ensuring a given fan efficiency. When it is assumed that there is no increase in mechanical loss for the fan operation because of utilization of the shaft rotation for driving the compression mechanism 10, the fan efficiency (pressure increase amount of work/shaft output) is about 50%.

When the radial flow passages 28 were not provided, the pressure increase effect at the upper part of the stator outer peripheral flow passage 25 was about 20% of the pressure increase effect at the exit of the centrifugal impeller 40.

Next, when the flow passage area of the radial flow passages 28 was ensured to be about half the flow passage area of the inter-vane flow passages 47, as in Embodiment 1, the pressure increase effect at the upper part of the stator outer peripheral flow passage 25 was about 40% of the pressure increase effect obtained in the centrifugal impeller 40.

[Vapor Compression Refrigeration Cycle Apparatus 101 and Oil Outflow Rate]

Figure 8:
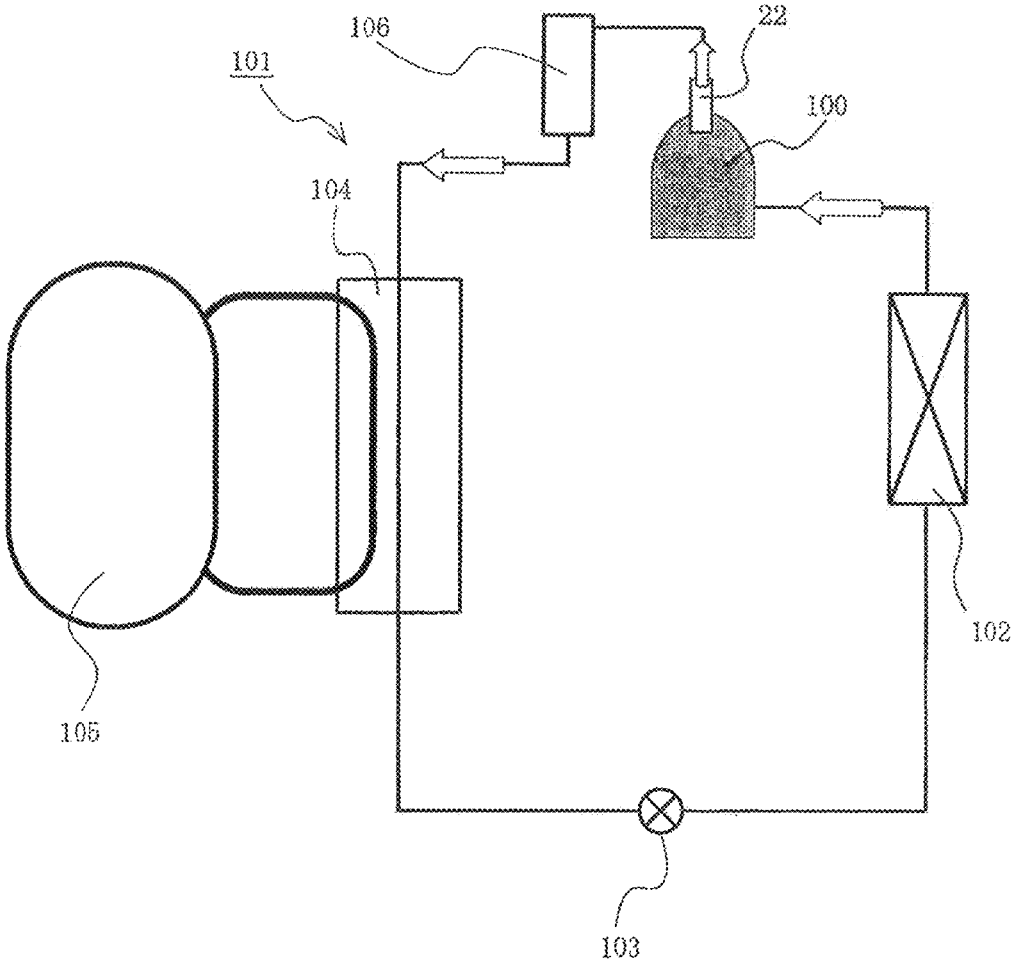
FIG. 8 is a view showing the configuration of a vapor compression refrigeration cycle apparatus including the sealed compressor of Embodiment 1.

FIG. 8 is a view showing the configuration of a vapor compression refrigeration cycle apparatus including the sealed compressor of Embodiment 1.

In a vapor compression refrigeration cycle apparatus 101, a refrigerant circuit is configured by connecting a sealed compressor 100, a radiator 104 (corresponding to a gas cooler when a $CO_2$ refrigerant is used and to a condenser when a fluorocarbon refrigerant is used), an expansion mechanism 103, and an evaporator 102 in order by a refrigerant pipe. In Embodiment 1, the refrigerant used is a $CO_2$ refrigerant. As the radiator 104, a water heat exchanger is adopted in which water circulating from a hot-water supply tank 105 is heated by heat released from the refrigerant. As the evaporator 102, an air heat exchanger is adopted in which the refrigerant removes heat from the outside air.

In the vapor compression refrigeration cycle apparatus 101 having the aforementioned configuration, a hot-water supply rated operation corresponding to an operation of boiling water from 15 degrees C. to 90 degrees C. was performed, and the outflow rate of lubricant oil contained in the refrigerant discharged from the sealed compressor 100 (oil outflow rate) and the hot-water supply COP were measured. The outflow of the lubricant oil contained in the refrigerant discharged from the sealed compressor 100 was measured with an oil separation measuring device provided between the sealed compressor 100 and the radiator 104.

As a result, in Example 1), the oil outflow rate was 1.4%, and the hot-water supply COP was 4.45. In Example 2), the oil outflow rate was 1.0%, and the hot-water supply COP was 4.48. In Example 3), the oil outflow rate was 0.5%, and the hot-water supply COP was 4.52. That is, the hot-water supply COP is higher in Example 3) by 1.5% than in Example 1). This shows that the oil outflow rate can be decreased by using the sealed compressor 100 of Embodiment 1 for the vapor compression refrigeration cycle apparatus 101 and that it is therefore possible to prevent performance deterioration due to adhesion of the lubricant oil to the interior of the heat exchanger (specifically, the radiator 104) and to improve the energy saving efficiency and the reliability of the vapor compression refrigeration cycle apparatus 101.

The vapor compression refrigeration cycle apparatus 101 of Embodiment 1 is just an example. The refrigerant used may be a $CO_2$ refrigerant, and an air heat exchanger may be adopted as the radiator 104, as a matter of course. Without limitations resulting from factors associated with the kind of the refrigerant and the type of the heat exchanger, the oil outflow rate can be decreased and the energy saving efficiency and reliability of the vapor compression refrigeration cycle apparatus 101 can be improved by using the sealed compressor 100 of Embodiment 1 in the vapor compression refrigeration cycle apparatus 101.

[Advantages]

In the sealed compressor 100 of Embodiment 1 having the above-described structure, the short-circuit flow passage to the discharge pipe 22 is blocked by closing the portion above the vanes 41 and on the inner peripheral side of the short diameter circumference 41*b* and the inter-vane flow passages 47 by the vane upper disk 43. Hence, it is possible to prevent a decrease in amount of lubricant oil stored in the sealed container 1 and to obtain the effect of suppressing deterioration of reliability due to lubrication failure and the effect of enhancing the energy saving performance.

By providing the vane lower disk 44 for closing the lower surface of the inter-vane flow passages 47, the leakage reduction effect (B) of the centrifugal impeller 40 is further increased. With this arrangement, it is possible to further prevent a decrease in amount of lubricant oil stored in the sealed container 1 and to obtain to a greater extent the effect of suppressing deterioration of reliability due to lubrication failure and the effect of enhancing the energy saving performance.

By providing the inner peripheral flow guide 42, the leakage reduction effect (B) of the centrifugal impeller 40 can further be increased. With this arrangement, it is possible to further prevent a decrease in amount of lubricant oil stored in the sealed container 1 and to obtain to a greater extent the effect of suppressing deterioration of reliability due to lubrication failure and the effect of enhancing the energy saving performance.

By disposing the rotor air holes 26 on the inner peripheral side of the short diameter circumference 41*b*, the fluid loss reduction effect (C) of the centrifugal impeller 40 is further increased. With this arrangement, it is possible to further prevent a decrease in amount of lubricant oil stored in the sealed container 1 and to obtain to a greater extent the effect of suppressing deterioration of reliability due to lubrication failure and the effect of enhancing the energy saving performance.

Since the entrance angle $\beta_1$ of the vanes 41 is set to fall within the range of ±5 degrees in the centrifugal impeller 40, the fluid loss reduction effect (C) of the centrifugal impeller 40 is further increased. With this configuration, it is possible to further prevent a decrease in amount of lubricant oil stored in the sealed container 1 and to obtain to a greater extent the effect of suppressing deterioration of reliability due to lubrication failure and the effect of enhancing the energy saving performance.

Since the vanes 41 of the centrifugal impeller 40 are formed by bending a single plate, the production cost of the centrifugal impeller 40 can be reduced.

By forming the radial flow passages 28 between the adjacent motor upper coil crossover wire portions 7*a*, the static pressure rise transmission effect (D) to the upper side of the stator outer peripheral flow passage 25 is further increased. With this arrangement, it is possible to further prevent a decrease in amount of lubricant oil stored in the sealed container 1 and to obtain to a greater extent the effect of suppressing deterioration of reliability due to lubrication failure and the effect of enhancing the energy saving performance.

Embodiment 2

Figure 9:
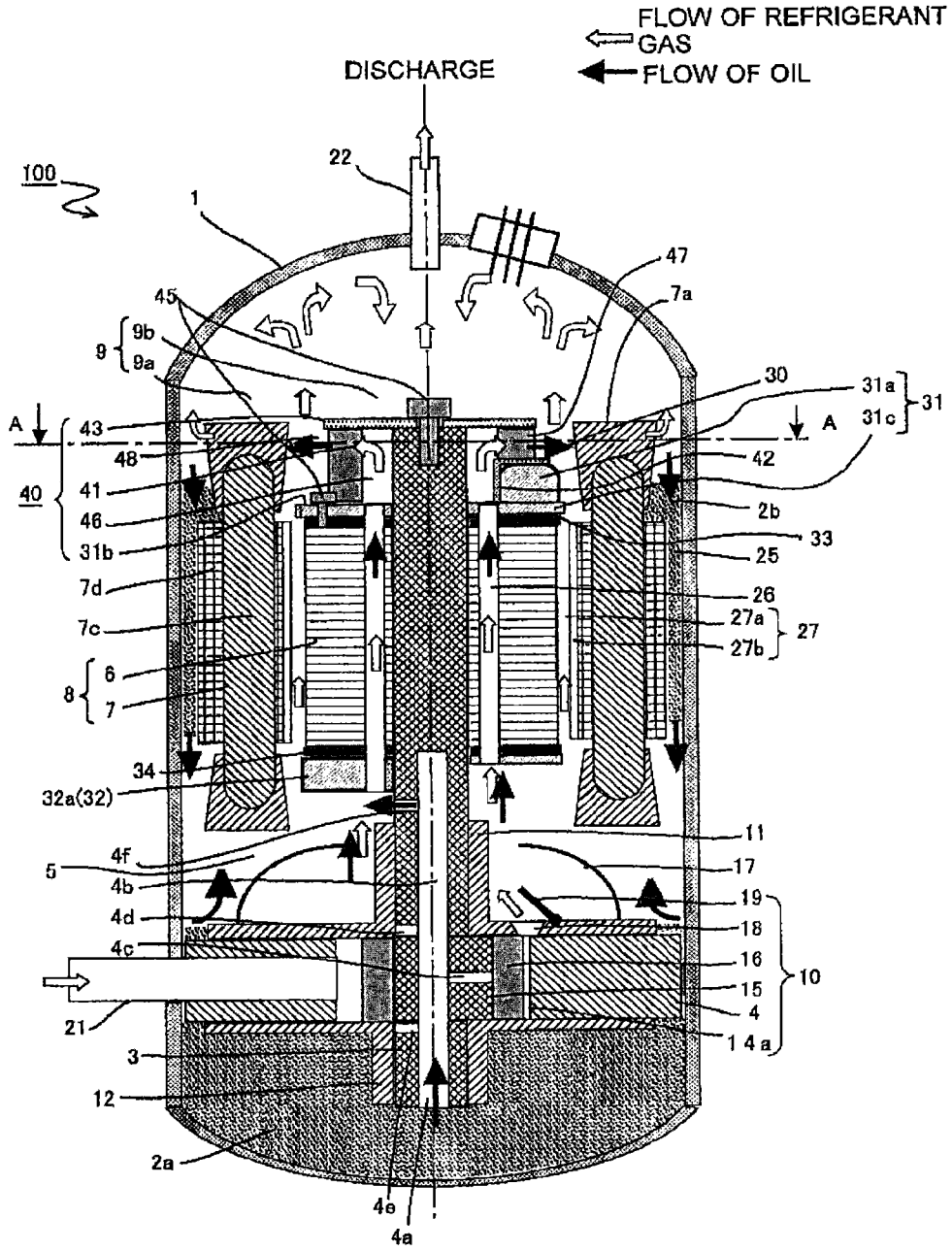
FIG. 9 is a longitudinal sectional view illustrating the structure of a sealed compressor according to Embodiment 2 of the present invention.
Figure 10:
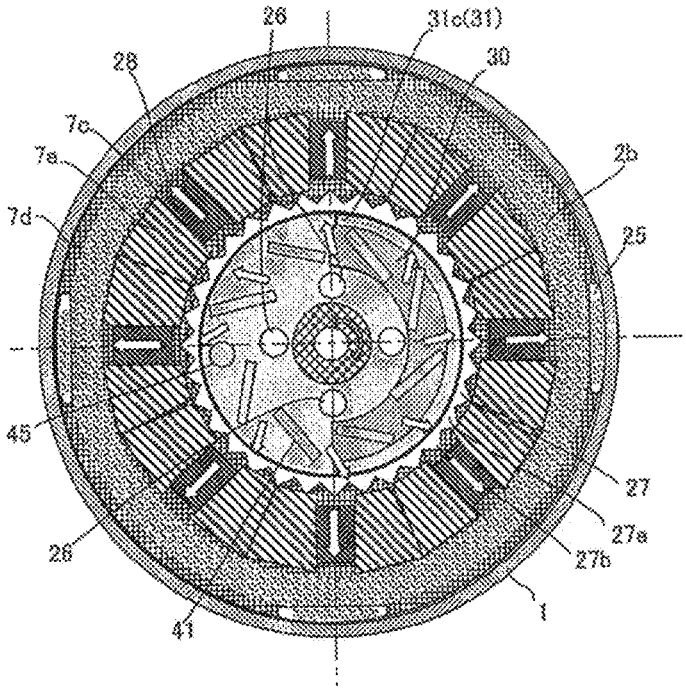
FIG. 10 is a transverse sectional view of the sealed compressor according to Embodiment 2 of the present invention (a sectional view taken along a line A-A of FIG. 9).

FIG. 9 is a longitudinal sectional view illustrating the structure of a sealed compressor according to Embodiment 2 of the present invention. FIG. 10 is a transverse sectional view of the sealed compressor according to Embodiment 2 of the present invention (a sectional view taken along a line A-A of FIG. 9).

A sealed compressor 100 of Embodiment 2 is different from the sealed compressor 100 of Embodiment 1 in the shape of a centrifugal impeller 40 and the structure near the centrifugal impeller 40. Other structures and operation of the sealed compressor 100 of Embodiment 2 are similar to those of Embodiment 1, and therefore, descriptions thereof are skipped.

Specifically, in Embodiment 1, eight vanes 41 that constitute the centrifugal impeller 40 are disposed in axial symmetry with respect to the drive shaft 3. The vanes 41 are equal in the angle, total length 41*e* (see FIG. 3), and height 41*d* (see FIG. 3). In contrast, in Embodiment 2, the height of vanes disposed on an upper side of a projection 31*a* of an upper balance weight 31, of eight vanes 41 that constitute the centrifugal impeller 40, is less than that of vanes 41 disposed on a flat portion 31*b* other than the projection 31*a* (that is, an upper flat surface of a support flat plate 31*c*). Further, in Embodiment 2, the distance between the vanes 41 where a fixing bolt 45 for fixing the support flat plate 31*c* enters an inter-vane flow passage 47 is wide. Hence, the eight vanes 41 that constitute the centrifugal impeller 40 are not in axial symmetry with respect to a drive shaft 3.

Even when the eight vanes 41 are thus nonuniform, as long as they are designed as described in conjunction with the leakage reduction effect (B) of the centrifugal impeller 40 and the fluid loss reduction effect (C) of the centrifugal impeller 40 in Embodiment 1, advantages similar to those of Embodiment 1 can be obtained. However, when the vanes 41 are nonuniform in height, attention is required because it is difficult to cover the lower side of inter-vane flow passages 47 without forming any gap. For example, the projection 31*a* and the support flat plate 31*c* of the upper balance weight 31 are frequently formed as an integral casting, and the upper surface of the projection 31*a* of the upper balance weight 31 is frequently curved. For this reason, a gap is preferably removed by covering at least the lower side of the inter-vane flow passages 47 disposed at a position opposed to the projection 31*a* of the upper balance weight 31 with a balancer cover 30 having an arc shape in a plan view (corresponding to the vane lower disk 44 in Embodiment 1). At this time, the vanes 41 disposed on the upper side of the balancer cover 30 have a small height 41*d*. The other vanes 41 extend near the flat portion 31*b* on the upper surface of the support flat plate 31*c* (that is, such as to close the gap between the vanes 41 and the upper end of the rotor 6), and have a large height 41*d*. In Embodiment 2, an inner peripheral flow guide 42 nearly shaped like an arc in a plan view corresponding to the shape of the balancer cover 30 is also provided between the balancer cover 30 and the support flat plate 31*c* (that is, at the upper end of the rotor 6) such that the refrigerant flowing out of rotor air holes 26 of the rotor 6 more easily flows into the inter-vane flow passages 47.

The nonuniform vanes 41 in Embodiment 2 can also be formed from a single metal plate, similarly to Embodiment 1. That is, the vanes 41 can be formed by bending a single metal plate as long as the height 41*d* of, for example, four vanes 41, in the developed view of the eight vanes of the centrifugal impeller 40 of Embodiment 1 illustrated in FIG. 3, are designed to be long.

[Advantages]

In the above-described sealed compressor 100 structured as in Embodiment 2, the lubricant oil separated in a motor upper space 9 does not accumulate on the upper side of a stator 7. The lubricant oil can be refluxed to a motor lower space 5, and further to a sealed-container bottom oil reservoir 2*a*. Therefore, the amount of oil to be discharged out of the sealed compressor 100 can be reduced, and the lubricant oil sealed in the sealed container 1 can be used effectively. Hence, it is possible to obtain the effect of suppressing performance deterioration of the heat exchanger (enhancing the energy saving performance) and the effect of suppressing reliability from being reduced due to lubrication failure caused by a decrease in amount of oil stored in the sealed container 1.

That is, even in the sealed compressor 100 structured as in Embodiment 2, advantages similar to those of Embodiment 1 can be obtained.

When the eight vanes 41 are nonuniform, the pressure increased by the centrifugal impeller 40 greatly varies, and this causes fluid vibration noise and increases the torque change of the drive shaft 3, and also may reduce fan efficiency and compressor efficiency. For this reason, while the advantages similar to those of Embodiment 1 can be obtained by adopting the centrifugal impeller 40 of Embodiment 2 in the sealed compressor 100, it is more preferable to adopt the centrifugal impeller 40 of Embodiment 1 in the sealed compressor 100.

Embodiment 3

Figure 11:
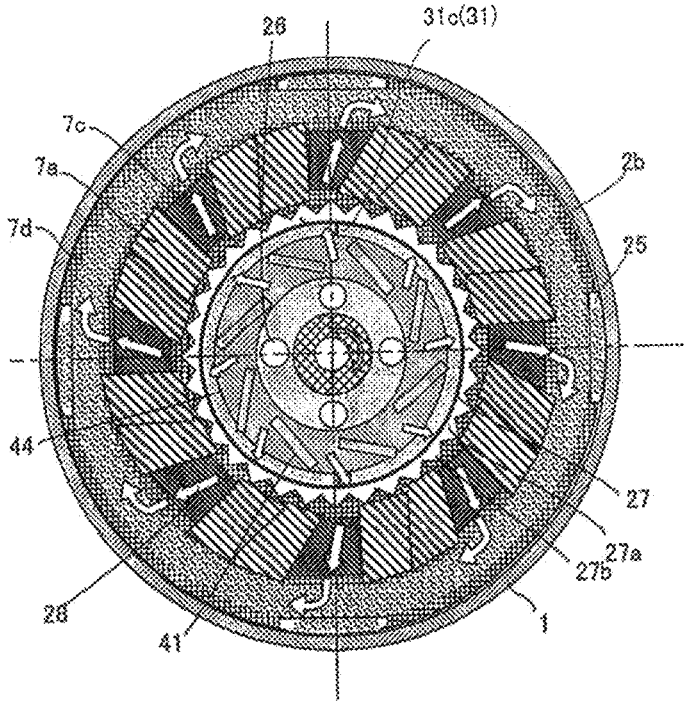
FIG. 11 is a transverse sectional view of a sealed compressor according to Embodiment 3 of the present invention.

FIG. 11 is a transverse sectional view of a sealed compressor according to Embodiment 3 of the present invention.

A sealed compressor 100 of Embodiment 3 is different from the sealed compressor 100 of Embodiment 1 in the structure of radial flow passages 28. Other structures and operation of the sealed compressor 100 of Embodiment 3 are similar to those of Embodiment 1, and therefore, descriptions thereof are skipped. The structure of the radial flow passages 28 of Embodiment 3 may be adopted in the sealed compressor 100 of Embodiment 2.

In Embodiment 1, the refrigerant, which flows into the inter-vane flow passages 47 through the rotor air holes 26 with rotation of the centrifugal impeller 40, is increased in pressure and flows out in the radial direction. Most of the refrigerant collides with the motor upper coil crossover wire portions 7*a*, and then rises through a cylindrical vane outer flow passage 48 (the flow passage provided between the outer periphery of the centrifugal impeller 40 and the motor upper coil crossover wire portions 7*a*, see FIG. 1). Part of the refrigerant that has flowed out of the inter-vane flow passages 47 in the radial direction is going to spread through the radial flow passages 28. At this time, if the flow passage area of the radial flow passages 28 is small, the pressure at the exit of the centrifugal impeller 40 is unlikely to be transmitted to the stator outer peripheral flow passage 25. Further, if the flow passage area of the radial flow passages 28 is large, the oil accumulated on the upper side of the stator outer peripheral flow passage 25 is stirred and the lubricant oil is likely to be whirled up. This increases the oil outflow amount. Further, if the kinetic energy of the refrigerant gas increased in pressure by the centrifugal impeller 40 is not efficiently converted into static pressure in the space on the upper side of the stator outer peripheral flow passage 25, pressure loss occurs.

As described above, when the radial flow passages 28 are not provided, the pressure increase effect on the upper side of the stator outer peripheral flow passage 25 is about 20% of the pressure increase effect at the exit of the centrifugal impeller 40. When the flow passage area of the radial flow passages 28 is ensured to be about half the flow passage area of the inter-vane flow passages 47, as in Embodiment 1, the pressure increase effect on the upper side of the stator outer peripheral flow passage 25 is about 40% of the pressure increase effect obtained by the centrifugal impeller 40.

Accordingly, in Embodiment 3, the shape and arrangement of motor upper coil crossover wire portions 7*a* are improved, and the radial flow passages 28 provided between the adjacent motor upper coil crossover wire portions 7*a* are diffuser-shaped (shaped such that the flow passage sectional area gradually increases from the upstream side toward the downstream side). This aims to efficiently convert the kinetic energy of the refrigerant gas, which is increased in pressure by the centrifugal impeller 40, into static pressure and to thereby increase the static pressure on the upper side of the stator outer peripheral flow passage 25. Further, in Embodiment 3, the radial flow passages 28 are inclined in the forward rotational direction of the drive shaft 3 (clockwise direction in FIG. 11) in a plan view along the flow direction of the refrigerant gas flowing out of the centrifugal impeller 40. By thus forming the radial flow passages 28 in the shape of the diffuser flow passages, the pressure increase effect on the upper side of the stator outer peripheral flow passage 25 is improved to about 60% of the pressure increase effect at the exit of the centrifugal impeller 40.

[Advantages]

This structure can provide the effect of reducing the fluid loss in a motor upper space 9 and the effect of increasing the static pressure on the upper side of the stator outer peripheral flow passage 25 to a degree equal to or higher than that in Embodiment 1. Therefore, the lubricant oil separated in the motor upper space 9 is less likely to accumulate on the upper side of a stator 7. The lubricant oil can be refluxed into a motor lower space 5, and further into a sealed-container bottom oil reservoir 2*a*. For this reason, the amount of oil to be discharged out of the sealed compressor 100 can be reduced, and the lubricant oil sealed in the sealed container 1 can be effectively used. Hence, it is possible to obtain the effect of suppressing performance deterioration of the heat exchanger (enhancing the energy saving performance) and the effect of suppressing deterioration of reliability due to lubrication failure caused by a decrease in amount of oil stored in the sealed container 1.

That is, in the sealed compressor 100 structured as in Embodiment 3, a decrease in amount of lubricant oil stored in the sealed container 1 can be prevented to a degree equal to or higher than that in Embodiment 1, and the effect of suppressing deterioration of reliability due to lubrication failure and the effect of enhancing the energy saving performance can be obtained.

Embodiment 4

Figure 12:
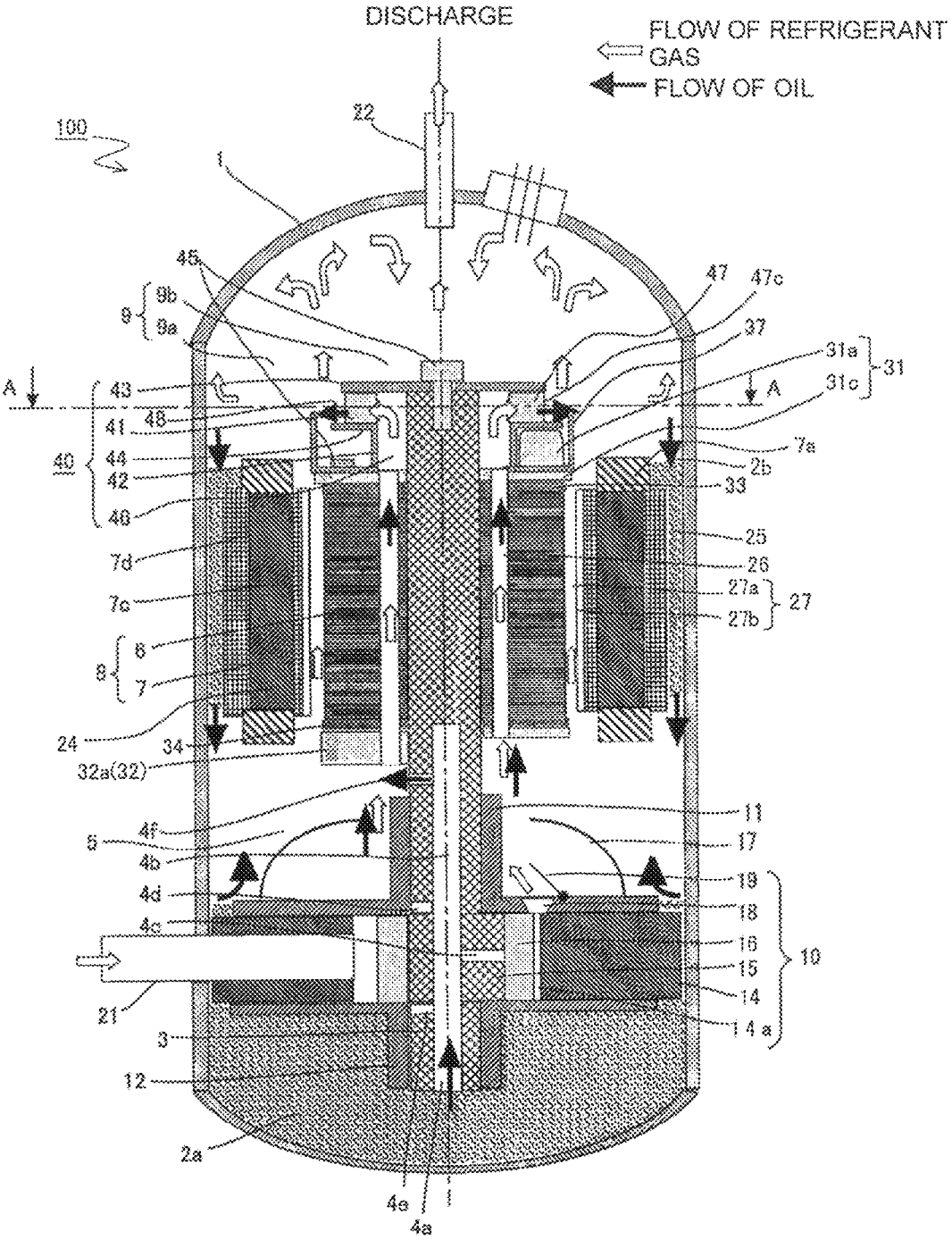
FIG. 12 is a longitudinal sectional view illustrating the structure of a sealed compressor according to Embodiment 4 of the present invention.
Figure 13:
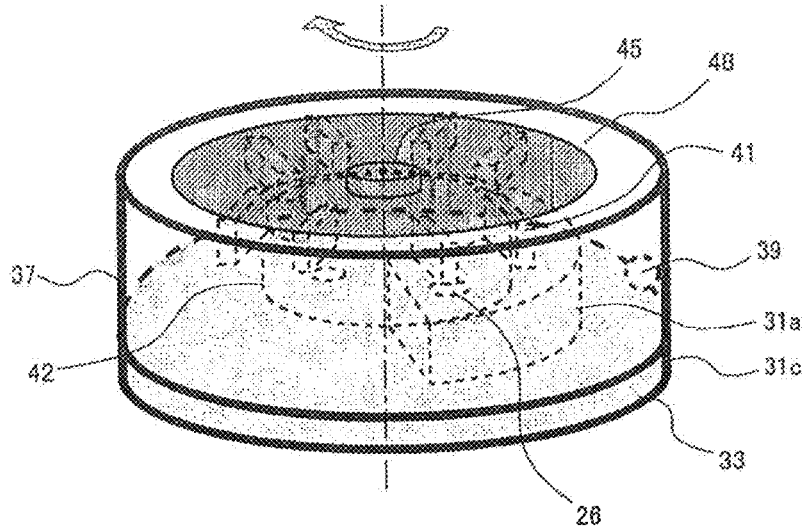
FIG. 13 is a perspective view illustrating the structure of the upper part of a rotor in Embodiment 4 of the present invention.

FIG. 12 is a longitudinal sectional view illustrating the structure of a sealed compressor according to Embodiment 4 of the present invention. FIG. 13 is a perspective view illustrating the structure of a part on the upper side of a rotor according to Embodiment 4 of the present invention. Differences between a sealed compressor 100 of Embodiment 4 and the sealed compressor 100 of Embodiment 1 will be described.

In Embodiment 1, the periphery of the projection 31*a* of the upper balance weight 31 is covered with the coil winding block 7*c* to cancel the influence of rotation of the projection 31*a*, which disturbs the oil surface of the stator upper oil reservoir 2*b*, on the stator upper space 9*a* on the upper side of the stator outer peripheral flow passage 25. In contrast, in Embodiment 4, a cylinder side wall 37 stands from a flat portion 31*b* on an upper side of a support flat plate 31*c* of an upper balance weight 31 to cover a portion of the upper balance weight 31 to the height of the projection 31*a*. Since a motor 8 including a stator 7 formed by a concentrated winding coil is used in the sealed compressor 100 of Embodiment 4, the sizes of a coil winding block 7*c* and motor upper coil crossover wire portions 7*a* are reduced. For this reason, in Embodiment 4, the cylinder side wall 37 is used as means for covering the projection 31*a* of the upper balance weight 31 and a part of a centrifugal impeller 40. At this time, a vane outer flow passage 48 is ensured by forming a sufficient gap between exits 47*c* of inter-vane flow passages 47 and the cylinder side wall 37. The cylinder side wall 37 blocks the flow in the radial direction from outer peripheral exits (exits 47*c*) of the inter-vane flow passages 47, and forms a part of the exit of the centrifugal impeller 40. The refrigerant gas increased in pressure by the centrifugal impeller 40 passes through the vane outer flow passage 48, flows out into a stator upper space 9*a*, is increased in pressure, and further spreads into a motor upper space 9.

While a bottom face of the cylinder side wall 37 of Embodiment 4 is formed by the support flat plate 31*c*, a drive shaft 3 and the bottom face may be integrally molded in a cup shape. Further, oil accumulated in the cup can be drained by forming an oil drain hole 39 in the bottom face of the cup.

In the sealed compressor 100 structured as in Embodiment 4, it is possible to obtain the effect of suppressing reliability deterioration due to lubrication failure caused by a decrease in amount of oil stored in the sealed container 1 and to thereby obtain advantages similar to those of Embodiment 1.

Embodiment 5

Figure 14:
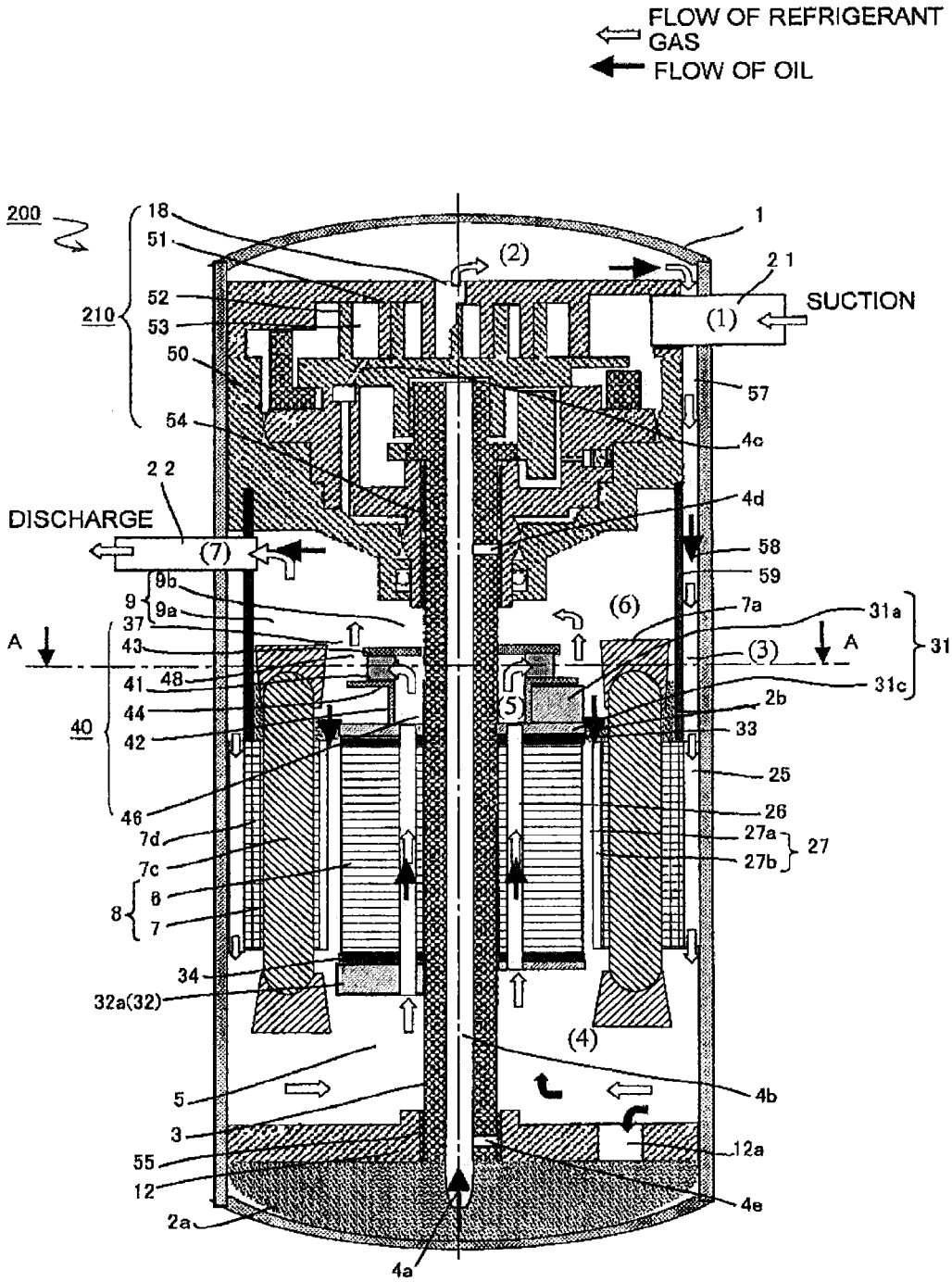
FIG. 14 is a longitudinal sectional view illustrating the structure of a sealed compressor according to Embodiment 5 of the present invention.

FIG. 14 is a longitudinal sectional view illustrating the structure of a sealed compressor according to Embodiment 5 of the present invention.

As illustrated in FIG. 14, a sealed compressor 200 of Embodiment 5 is a high-pressure shell, sealed scroll compressor. That is, the sealed compressor 200 of Embodiment 5 is different from Embodiment 1 in that the compression mechanism is a scroll compression mechanism (hereinafter, the scroll compression mechanism will be referred to as a compression mechanism 210) and that the compression mechanism 210 is disposed above a motor 8. Further, the sealed compressor 200 of Embodiment 5 is different from Embodiment 1 in that a compressed refrigerant is temporarily discharged from a discharge port 18 into a space on the upper side of a discharge pipe 22 in a sealed container 1. The structure of a part on the upper side of a rotor 6 and the structure of a centrifugal impeller 40, which are characteristics of the present invention, are exactly the same as those adopted in Embodiment 1, and descriptions thereof are skipped.

[Basic Structure and Operation of Sealed Compressor 200]

The basic structure and operation of the sealed compressor 200 of Embodiment 5 will be described briefly.

As described above, the compression mechanism 210 of Embodiment 5 includes a fixed scroll 51 and a swing scroll 52. The fixed scroll 51 has a platelike scroll lap on its lower surface, and is fixed to a compressor housing 50. The swing scroll 52 has, on its upper surface, a platelike scroll lap to be meshed with the platelike scroll lap of the fixed scroll 51, and is swingably provided at an upper end portion of a drive shaft 3. The platelike scroll lap of the fixed scroll 51 and the platelike scroll lap of the swing scroll 52 are meshed to form a compression chamber 53 between them. When the swing scroll 52 eccentrically orbits relative to the fixed scroll 51, the volume in the compression chamber 53 gradually decreases, and this compresses the refrigerant in a cylinder chamber 14*a*.

The compressor housing 50 is fixed to an inner peripheral surface of the sealed container 1, for example, by press fitting or welding, and has an upper bearing 54 for rotatably supporting the drive shaft 3. The upper bearing 54 rotatably supports the drive shaft 3 together with a lower bearing 55 provided below the motor 8. The compressor housing 50 also has a refrigerant flow passage 57 between an outer peripheral portion thereof and the sealed container 1. On the lower side of the compressor housing 50, a motor upper space outer peripheral cover 59 extends from an upper end of a stator 7 in the motor 8 to a lower surface of the compressor housing 50, and is disposed at a predetermined distance from the sealed container 1. That is, between the motor upper space outer peripheral cover 59 and the sealed container 1, a motor upper space outer peripheral flow passage 58 is provided to communicate with the refrigerant flow passage 57.

[Discharged Gas Outflow Passage]

When the rotor 6 and the drive shaft 3 rotate, the swing scroll 52 eccentrically orbits relative to the fixed scroll 51. A low-pressure intake refrigerant is thereby drawn by suction from a suction pipe 21 ((1) in FIG. 14) into the compression chamber 53 formed by the platelike scroll laps of the fixed scroll 51 and the swing scroll 52. As the swing scroll 52 driven by the drive shaft 3 supported by the upper bearing 54 and the lower bearing 55 eccentrically orbits, the volume in the compression chamber 53 is decreased. By this compression process, the intake refrigerant is increased to high pressure, and is discharged from the discharge port 18 of the fixed scroll 51 into an upper shell discharge space ((2) in FIG. 14) in the sealed container 1.

The refrigerant discharged from the discharge port 18 flows downwards through the refrigerant flow passage 57 formed by the gap between the outer periphery of the compressor housing 50 and the sealed container 1. This refrigerant passes through the motor upper space outer peripheral flow passage 58 ((3) in FIG. 14) formed by the gap between the motor upper space outer peripheral cover 59 and the sealed container 1, and is guided to a stator outer peripheral flow passage 25. The refrigerant flowing in the stator outer peripheral flow passage 25 flows downwards through the stator outer peripheral flow passage 25, flows into a motor lower space 5 ((4) in FIG. 14), and reaches a lower bearing section 12 where the lower bearing 55 is provided. In this process, the lubricant oil mixed in a spray state is separated from the refrigerant, and the separated lubricant oil is refluxed from an oil return hole 12*a* provided in the lower bearing section 12 into a sealed-container bottom oil reservoir 2*a*.

In contrast, the refrigerant that has reached the motor lower space 5 rises from the motor lower space 5 through rotor air holes 26 of the rotor 6, and flows into a vane inner flow passage 46 ((5) in FIG. 14) of a centrifugal impeller 40 attached to the upper side of the rotor 6. This refrigerant is drawn by suction into inter-vane flow passages 47 of the centrifugal impeller 40, flows to the outer periphery while being increased in pressure by the rotation speed of the centrifugal impeller 40, and rises through a vane outer flow passage 48. The refrigerant is temporarily released into a motor upper space 9 ((6) in FIG. 14), and is discharged from the discharge pipe 22 of the sealed container 1 to an external circuit ((7) in FIG. 14).

[Oil Flow and Oil Outflow Passage]

The lubricant oil stored in the sealed-container bottom oil reservoir 2*a* is supplied to the components of the compression mechanism 210. Specifically, when the drive shaft 3 rotates, the lubricant oil stored in the sealed-container bottom oil reservoir 2*a* is drawn up by suction from an oil suction hole 4*a* at the lower end of the drive shaft 3, and is caused to flow into a cavity 4*b* penetrating the shaft center of the drive shaft 3. Then, the lubricant oil is supplied from oil supply holes 4*d* and 4*e* into the gap between the outer periphery of the drive shaft 3 and the inner periphery of the upper bearing 54 and the gap between the outer periphery of the drive shaft 3 and the inner periphery of the lower bearing 55, respectively, so as to contribute to lubrication of the compression mechanism 210 and sealing of the compressed gas. Part of the lubricant oil is also supplied to the compression chamber 53 via an oil supply hole 4*c* and other oil supply gaps. This lubricant oil is compressed in the compression chamber 53, and is discharged from the discharge port 18 into the upper shell discharge space ((2) in FIG. 14) while mixing with the refrigerant gas.

The refrigerant gas, which has lowered through the motor upper space outer peripheral flow passage 58 and the stator outer peripheral flow passage 25 and has reached the motor lower space 5 ((4) in FIG. 14), is separated from oil by colliding with the wall of the lower bearing section 12 or the like. However, part of the lubricant oil is whirled up by the rotation of the rotor 6, rises through the rotor air holes 26 together with the refrigerant gas, and flows into the vane inner flow passage 46 ((5) in FIG. 14). Then, this lubricant oil flows from the vane inner flow passage 46 into inter-vane flow passages 47 in the centrifugal impeller 40, flows out toward the outer periphery of the centrifugal impeller 40 together with the refrigerant gas increased in pressure in the inter-vane flow passages 47 of the centrifugal impeller 40, and reaches the motor upper space 9 ((6) in FIG. 14) through the vane outer flow passage 48. Part of the lubricant oil supplied from the oil supply hole 4*d* of the drive shaft 3 to the upper bearing 54 also flows downwards through the gap between the outer periphery of the drive shaft 3 and the inner periphery of the upper bearing 54, and is released into the motor upper space 9 ((6) in FIG. 14). Oil droplets that are not separated, of the lubricant oil (oil droplets) reaching the motor upper space 9 ((6) in FIG. 14), are released from the discharge pipe 22 to the outside of the sealed container together with the refrigerant gas.

[Stator Upper Oil Reservoir 2*b* and Problem]

The oil droplets separated in the motor upper space 9 are likely to gather near the side wall of the sealed container 1 within the stator upper space 9*a* by the action of centrifugal force produced by the rotation of the rotor 6. The oil droplets are likely to settle out on the upper outer peripheral side of the stator 7 and to form a stator upper oil reservoir 2*b*. The oil in the stator upper oil reservoir 2*b* passes through a coil gap flow passage 24 of a coil winding block 7*c* and a stator inner peripheral flow passage 27, and falls by gravity from the motor upper space 9 into the motor lower space 5. If the pressure decrease is large in the motor upper space 9, the stator upper oil surface height ($\Delta H$) increases, the amount of oil stored in the sealed-container bottom oil reservoir 2*a* decreases, and the oil surface height also decreases. Alternatively, the amount of oil, which is whirled up from the stator upper oil reservoir 2*b* and flows out of the sealed container through the discharge pipe 22 together with the refrigerant gas, increases. As a result, the amount of oil to be supplied to the compression mechanism 210 decreases, and this causes deterioration of lubrication reliability and an increase in amount of leakage of the compressed gas.

Accordingly, in Embodiment 5, the pressure in the motor upper space 9 is increased by appropriately designing and disposing the centrifugal impeller 40 on the upper side of the rotor 6, similarly to Embodiment 1 of the present invention. This makes the pressure in the motor upper space 9 higher than in the motor lower space 5 or suppresses the decrease in pressure in the motor upper space 9 more than in the conventional technique to prevent an increase in amount of oil flowing out of the sealed container 1 (that is, a decrease in amount of oil stored in the sealed-container bottom oil reservoir 2*a*). Regarding means for appropriately designing and disposing the centrifugal impeller, similarly to Embodiments 1 to 3, it is important to pay attention to (A) the cost reduction effect of the centrifugal impeller 40, (B) the leakage reduction effect of the centrifugal impeller 40, (C) the fluid loss reduction effect of the centrifugal impeller 40, and (D) the static pressure rise transmission effect to the upper side of the stator outer peripheral flow passage 25.

[Advantages]

According to this structure, the effect of increasing the pressure in the motor upper space 9 (for example, at the level of several kilopascals) can be obtained by utilizing the rotation of the rotor 6 in the sealed container 1. As a result, it is possible to suppress the outflow of oil to the external circuit of the sealed compressor 200 and to effectively use the lubricant oil sealed in the sealed container 1. Hence, it is possible to obtain the effect of suppressing performance deterioration of the heat exchanger (enhancing the energy saving performance) and the effect of suppressing deterioration of reliability due to lubrication failure caused by a decrease in amount of oil stored in the sealed container 1.

That is, in the sealed compressor 200 structured as in Embodiment 5, advantages similar to those of Embodiment 1 can be obtained.

The high-pressure shell, sealed rolling piston rotary compressor of Embodiments 1 to 3 and the high-pressure shell, sealed scroll compressor of Embodiment 5 have been described above. In the sealed compressor in which the compression mechanism and the motor coexist within the same sealed container, as long as the rotor 6 and the stator 7 in the motor 8 are similarly disposed and the refrigerant similarly flows from the motor lower space 5 to the motor upper space 9, similar advantages can also be obtained using means similar to those of Embodiments 1 to 5 in other shell types and other compression methods. For example, similar advantages can be obtained even when the compressor is semi-sealed. Alternatively, similar advantages can be obtained when the compressor is an intermediate pressure shell compressor or a low-pressure shell compressor. Further, similar advantages can be obtained in other rotary compression methods (sliding vane method, swing method).

REFERENCE SIGNS LIST

1: sealed container, 2*a*: sealed-container bottom oil reservoir, 2*b*: stator upper oil reservoir, 3: drive shaft, 4*a*: oil suction hole, 4*b*: cavity, 4*c*, 4*d*, 4*e*: oil supply hole, 4*f*: degassing hole, 5: motor lower space, 6: rotor, 7: stator, 7*a*: motor upper coil crossover wire portion, 7*c*: coil winding block, 7*d*: core, 8: motor, 9: motor upper space, 9*a*: stator upper space, 9*b*: rotor upper space, 10: compression mechanism, 11: upper bearing section, 12: lower bearing section, 12*a*: oil return hole, 14: cylinder, 14*a*: cylinder chamber, 15: eccentric pin shaft portion, 16: rotary piston, 17: discharge muffler, 18: discharge port, 19: discharge valve, 21: suction pipe, 22: discharge pipe, 24: coil gap flow passage, 25: stator outer peripheral flow passage, 26: rotor air hole, 27: stator inner peripheral flow passage, 27*a*: air gap, 27*b*: core inner peripheral cutout flow passage, 28: radial flow passage, 30: balancer cover, 31: upper balance weight, 31*a*: projection, 31*b*: flat portion, 31*c*: support flat plate, 32: lower balance weight, 32*a*: projection, 33: rotor upper fixing substrate, 34: rotor lower fixing substrate, 37: cylinder side wall, 39: oil drain hole, 40: centrifugal impeller, 41: vane, 41*b*: short diameter circumference, 41*c*: long diameter circumference, 41*d*: height, 41*e*: total length, 42: inner peripheral flow guide, 43: vane upper disk, 44: vane lower disk, 45: fixing bolt, 46: vane inner flow passage, 47: inter-vane flow passage, 47*a*: effective flow passage area, 47*b*: effective length, 47*c*: exit, 48: vane outer flow passage, 50: compression mechanism housing, 51: fixed scroll, 52: swing scroll, 53: compression chamber, 54: upper bearing, 55: lower bearing, 57: refrigerant flow passage, 58: motor upper space outer peripheral flow passage, 59: motor upper space outer peripheral cover, 100: sealed compressor, 101: vapor compression refrigeration cycle apparatus, 102: evaporator, 103: expansion mechanism, 104: radiator, 105: hot-water supply tank, 106: oil separation measuring device, 200: sealed container, 210: compression mechanism.

The invention claimed is:

1. A sealed compressor comprising:

a sealed container that stores lubricant oil at a bottom thereof;

a motor that is provided within the sealed container and has a stator and a rotor;

a drive shaft attached to the rotor;

a compression mechanism that is provided within the sealed container and configured to compress a refrigerant upon rotation of the drive shaft;

a centrifugal impeller that is provided above the rotor and configured to rotate in synchronization with the rotor;

a rotor air hole that penetrates the rotor in an up-down direction; and a discharge pipe configured to cause the refrigerant, upon flowing into a lower space of the motor, rising through the rotor air hole, and flowing into an upper space of the motor, to flow out from the upper space to an external circuit of the sealed container, wherein the centrifugal impeller includes an oil separation plate and a lower surface partition plate that are provided on an upper side of an upper end of the rotor so as to be spaced apart from each other, a plurality of vanes that stand downwards from a lower surface of the oil separation plate and are provided from an inner peripheral side toward an outer peripheral side, and inter-vane flow passages each provided between two adjacent vanes of the plurality of vanes, and a vane inner flow passage that guides the refrigerant, upon flowing out from the rotor air hole, to inner peripheral entrances of the inter-vane flow passages, wherein the inter-vane flow passages are arranged along an entire circumference to guide the refrigerant from the inner peripheral entrances thereof to outer peripheral exits thereof, and cause the refrigerant increased in pressure while passing through the inter-vane flow passages to flow out from the outer peripheral exits into the upper space, and wherein the oil separation plate covers an upper surface of the inter-vane flow passages to close an upper end of the vane inner flow passage, and the lower surface partition plate covers a lower surface of the inter-vane flow passages to close a short-circuit passage through which the refrigerant that has risen through the rotor air hole directly flows out to the discharge pipe without passing through the inter-vane flow passages.

2. The sealed compressor of claim 1, wherein the upper surface of the inter-vane flow passages is entirely covered with the oil separation plate, and the lower surface of the inter-vane flow passages is entirely covered with the lower surface partition plate.

3. The sealed compressor of claim 1, wherein the lower surface partition plate is disposed parallel to the oil separation plate in a direction of the drive shaft at a fixed distance therefrom.

4. The sealed compressor of claim 3, further comprising an upper balance weight including a support flat plate to be fixed to the rotor and a projection that projects upwards from a part of the support flat plate and functions as a weight, the upper balance weight being provided at the upper end of the rotor, wherein the lower surface of the inter-vane flow passages is covered with at least one of the lower surface partition plate, the support flat plate of the upper balance weight, and an upper surface of the projection of the upper balance weight.

5. The sealed compressor of claim 4, wherein the lower surface partition plate that closes the lower surface of the inter-vane flow passages from the inner peripheral entrances to the outer peripheral exits is provided at least on a lower portion of the vanes in an area opposed to the projection of the upper balance weight, and wherein the vanes under which the lower surface partition plate is not disposed extend to a portion near an upper end of the support flat plate of the upper balance weight.

6. The sealed compressor of claim 3, further comprising a flow guide that guides the refrigerant flowing out from the rotor air hole to the inter-vane flow passages, the flow guide being connected at an upper end portion to an inner peripheral end portion of the lower surface partition plate, and being in contact at a lower end portion with an upper end of a member having an upper end opening defining the rotor air hole on an outer peripheral side of the rotor air hole.

7. The sealed compressor of claim 3, wherein the lower surface partition plate is disposed on an entire lower surface of the plurality of vanes, and wherein the vanes are uniform in length in the up-down direction.

8. The sealed compressor of claim 7, further comprising a hollow cylindrical flow guide that guides the refrigerant flowing out from the rotor air hole to the inter-vane flow passages, the hollow cylindrical flow guide being connected at an upper end portion to an inner peripheral end portion of the lower surface partition plate, and being in contact at a lower end portion with an upper end of a member having an upper end opening defining the rotor air hole on an outer peripheral side of the rotor air hole.

9. The sealed compressor of claim 1, wherein the plurality of vanes are disposed in axial symmetry with respect to the drive shaft.

10. The sealed compressor of claim 1, wherein a flow passage area of the rotor air hole provided in the rotor is more than an area of a flow passage formed between an outer periphery of the rotor and an inner periphery of the stator.

11. The sealed compressor of claim 1, wherein the rotor air hole is disposed on an inner peripheral side of a short diameter circumference having as a center the drive shaft in a plan view, the short diameter circumference being formed by a circle that connects inner peripheral end portions of the vanes.

12. The sealed compressor of claim 1, wherein the oil separation plate is a disk symmetrical with respect to the drive shaft.

13. The sealed compressor of claim 7, wherein the lower surface partition plate is a disk symmetrical with respect to the drive shaft, and wherein the lower surface partition plate includes a flow passage hole through which the refrigerant flowing out from the rotor air hole flows into the inter-vane flow passages, the flow passage hole being provided on an inner side of a short diameter circumference having as a center the drive shaft, and the short diameter circumference being formed by a circle that connects inner peripheral end portions of the vanes.

14. The sealed compressor of claim 1, wherein the vanes has an entrance angle determined such that the vanes are in contact with a short diameter circumference having as a center the drive shaft at an angle which falls within a range of ±5 degrees in a plan view, the short diameter circumference being formed by a circle that connects inner peripheral end portions of the vanes.

15. The sealed compressor of claim 1, wherein the vanes are linear vanes.

16. The sealed compressor of claim 1, wherein the plurality of vanes are formed by bending and raising a single plate at right angles.

17. The sealed compressor of claim 1, further comprising an upper balance weight including a support flat plate to be fixed to the rotor and a projection that projects upwards from a part of the support flat plate and functions as a weight, the upper balance weight being provided at an upper end of the rotor, wherein a covering wall is provided on the stator to block a flow in a radial direction from the outer peripheral exits of the inter-vane flow passages by surrounding an entire area around the projection of the upper balance weight and the outer peripheral exits of the inter-vane flow passages in the centrifugal impeller or a part of the surrounding area.

18. The sealed compressor of claim 17, wherein the covering wall completely covers at least an entire area around the projection of the upper balance weight.

19. The sealed compressor of claim 17, wherein the stator has a plurality of motor upper coil crossover wire portions where a coil wound around a core projects upwards from the stator, wherein a plurality of radial flow passages are disposed along an entire periphery between the adjacent motor upper coil crossover wire portions to guide the refrigerant flowing in the radial direction from the outer peripheral exits of the inter-vane flow passages toward a side wall of the sealed container, and wherein the radial flow passages are diffuser-shaped, and are disposed to be inclined in a forward rotational direction of the drive shaft in a plan view from above.

20. The sealed compressor of claim 1, further comprising an upper balance weight including a support flat plate to be fixed to the rotor and a projection that projects upwards from a part of the support flat plate and functions as a weight, the upper balance weight being provided at an upper end of the rotor, wherein a cylindrical side wall is provided to surround an entire area around the projection of the upper balance weight provided at the upper end of the rotor and to rotate in synchronization with the rotor.

21. The sealed compressor of claim 20, wherein the cylindrical side wall forms a part of an exit of the centrifugal impeller by blocking a flow in a radial direction from the outer peripheral exits of the inter-vane flow passages.

22. A vapor compression refrigeration cycle apparatus comprising:

a sealed compressor comprising:

a sealed container that stores lubricant oil at a bottom thereof, a motor that is provided within the sealed container and has a stator and a rotor, a drive shaft attached to the rotor, a compression mechanism that is provided within the sealed container and configured to compress a refrigerant upon rotation of the drive shaft, a centrifugal impeller that is provided above the rotor and configured to rotate in synchronization with the rotor, a rotor air hole that penetrates the rotor in an up-down direction, and a discharge pipe configured to cause the refrigerant, upon flowing into a lower space of the motor, rising through the rotor air hole, and flowing into an upper space of the motor, to flow out from the upper space to an external circuit of the sealed container, wherein the centrifugal impeller includes:

an oil separation plate and a lower surface partition plate that are provided on an upper side of an upper end of the rotor so as to be spaced apart from each other, a plurality of vanes that stand downwards from a lower surface of the oil separation plate and are provided from an inner peripheral side toward an outer peripheral side, and inter-vane flow passages each provided between two adjacent vanes of the plurality of vanes, and a vane inner flow passage that guides the refrigerant, upon flowing out from the rotor air hole, to inner peripheral entrances of the inter-vane flow passages, wherein the inter-vane flow passages are arranged along an entire circumference to guide the refrigerant from the inner peripheral entrances thereof to outer peripheral exits thereof, and cause the refrigerant increased in pressure while passing through the inter-vane flow passages to flow out from the outer peripheral exits into the upper space, and wherein the oil separation plate covers an upper surface of the inter-vane flow passages to close an upper end of the vane inner flow passage, and the lower surface partition plate covers a lower surface of the inter-vane flow passages to close a short-circuit passage through which the refrigerant that has risen through the rotor air hole directly flows out to the discharge pipe without passing through the inter-vane flow passages;

a radiator that rejects heat from the refrigerant compressed by the sealed compressor;

an expansion mechanism that expands the refrigerant, upon flowing out of the radiator; and an evaporator that causes the refrigerant, upon flowing out of the expansion mechanism, to receive heat.

* * * * *